US008632280B2

(12) United States Patent
Taylor

(10) Patent No.: US 8,632,280 B2
(45) Date of Patent: Jan. 21, 2014

(54) MECHANICALLY STABILIZED EARTH WELDED WIRE FACING CONNECTION SYSTEM AND METHOD

(75) Inventor: Thomas P. Taylor, Colleyville, TX (US)

(73) Assignee: T & B Structural Systems LLC

( * ) Notice: Subject to any disclaimer, the term of this patent is extended or adjusted under 35 U.S.C. 154(b) by 0 days.

(21) Appl. No.: 13/457,854

(22) Filed: Apr. 27, 2012

(65) Prior Publication Data

US 2012/0224927 A1 Sep. 6, 2012

Related U.S. Application Data

(63) Continuation-in-part of application No. 12/837,347, filed on Jul. 15, 2010, which is a continuation of application No. 12/818,011, filed on Jun. 17, 2010.

(51) Int. Cl.

| | |
|---|---|
| ***E21D 20/00*** | (2006.01) |
| ***E21D 21/00*** | (2006.01) |
| ***E02D 29/00*** | (2006.01) |

(52) U.S. Cl.

USPC ..... 405/262; 405/284; 405/302.4

(58) Field of Classification Search

USPC ..... 405/262, 284, 258.1, 302.4, 302.6, 405/302.7

See application file for complete search history.

(56) References Cited

U.S. PATENT DOCUMENTS

| | | | | |
|---|---|---|---|---|
| 991,041 | A | | 5/1911 | Toennes |
| RE13,299 | E | | 10/1911 | Denison |
| 1,012,008 | A | * | 12/1911 | Post ..... 403/46 |
| 1,144,143 | A | * | 6/1915 | McGillivray ..... 405/20 |
| 1,813,912 | A | | 7/1931 | Clark |
| 1,959,816 | A | | 5/1934 | Crum |
| 1,992,785 | A | | 2/1935 | Steuer |
| 2,137,153 | A | | 11/1938 | Brozek |
| 2,208,589 | A | | 7/1940 | Leemhuis |
| 2,275,933 | A | | 3/1942 | Werner |
| 2,316,712 | A | | 4/1943 | Prince |
| 2,327,640 | A | | 8/1943 | Hendry |
| 2,552,712 | A | | 5/1951 | Ellis |
| 2,703,963 | A | | 3/1955 | Gutierrez |

(Continued)

FOREIGN PATENT DOCUMENTS

| | | |
|---|---|---|
| EP | 427221 A | 5/1991 |
| EP | 0679768 | 2/1995 |

(Continued)

OTHER PUBLICATIONS

International Application No. PCT/US08/69011—International Search Report and Written Opinion dated Oct. 10, 2008.

(Continued)

*Primary Examiner* — Frederick L Lagman
*Assistant Examiner* — Patrick Lambe
(74) *Attorney, Agent, or Firm* — Edmonds & Nolte, PC

(57) ABSTRACT

A system and method of constructing a mechanically stabilized earth (MSE) structure. A wire facing is composed of horizontal and vertical elements. The system includes a soil reinforcing element having a plurality of transverse wires coupled to at least two longitudinal wires. The soil reinforcing element is coupled to a facing anchor configured such that at least a portion of the facing anchor is inserted through the wire facing and coupled thereto. Multiple systems can be characterized as lifts and erected one atop the other to a desired MSE structure height.

20 Claims, 9 Drawing Sheets

(56) References Cited

U.S. PATENT DOCUMENTS

| | | | | | |
|---|---|---|---|---|---|
| 2,881,614 | A | | 4/1959 | Preininger | |
| 3,316,721 | A | * | 5/1967 | Heilig | 405/262 |
| 3,597,928 | A | | 8/1971 | Pilaar | |
| 3,680,748 | A | * | 8/1972 | Brunhuber | 223/98 |
| 3,998,022 | A | | 12/1976 | Muse | |
| 4,075,924 | A | | 2/1978 | McSherry | |
| 4,116,010 | A | | 9/1978 | Vidal | |
| 4,117,686 | A | | 10/1978 | Hilfiker | |
| 4,123,881 | A | | 11/1978 | Muse | |
| 4,134,241 | A | | 1/1979 | Walton | |
| 4,193,718 | A | * | 3/1980 | Wahrendorf et al. | 405/286 |
| 4,286,895 | A | | 9/1981 | Poli | |
| 4,324,508 | A | | 4/1982 | Hilfiker | |
| 4,329,089 | A | * | 5/1982 | Hilfiker et al. | 405/262 |
| 4,341,491 | A | | 7/1982 | Neumann | |
| 4,343,572 | A | * | 8/1982 | Hilfiker | 405/284 |
| 4,391,557 | A | | 7/1983 | Hilfiker | |
| 4,411,255 | A | | 10/1983 | Lee | |
| 4,470,728 | A | | 9/1984 | Broadbent | |
| 4,505,621 | A | * | 3/1985 | Hilfiker et al. | 405/284 |
| 4,514,113 | A | | 4/1985 | Neumann | |
| 4,616,959 | A | | 10/1986 | Hilfiker | |
| 4,643,618 | A | | 2/1987 | Hilfiker | |
| 4,651,975 | A | | 3/1987 | Howell | |
| 4,653,962 | A | | 3/1987 | McKittrick | |
| 4,661,023 | A | | 4/1987 | Hilfiker | |
| 4,664,552 | A | | 5/1987 | Schaaf | |
| 4,710,062 | A | | 12/1987 | Vidal | |
| 4,725,170 | A | * | 2/1988 | Davis | 405/286 |
| 4,834,584 | A | | 5/1989 | Hilfiker | |
| 4,856,939 | A | * | 8/1989 | Hilfiker | 405/284 |
| 4,914,876 | A | | 4/1990 | Forsberg | |
| 4,920,712 | A | | 5/1990 | Dean, Jr. | |
| 4,929,125 | A | * | 5/1990 | Hilfiker | 405/262 |
| 4,952,098 | A | | 8/1990 | Grayson | |
| 4,961,673 | A | | 10/1990 | Pagano | |
| 4,968,186 | A | | 11/1990 | Ogorchock | |
| 4,993,879 | A | * | 2/1991 | Hilfiker | 405/262 |
| 5,044,833 | A | * | 9/1991 | Wilfiker | 405/267 |
| 5,066,169 | A | | 11/1991 | Gavin | |
| 5,076,735 | A | | 12/1991 | Hilfiker | |
| 5,139,369 | A | | 8/1992 | Jaecklin | |
| 5,156,496 | A | | 10/1992 | Vidal | |
| 5,190,413 | A | | 3/1993 | Carey | |
| 5,207,038 | A | | 5/1993 | Negri | |
| RE34,314 | E | | 7/1993 | Forsberg | |
| 5,242,249 | A | * | 9/1993 | Grayson | 405/286 |
| 5,257,880 | A | | 11/1993 | Janopaul | |
| 5,259,704 | A | * | 11/1993 | Orgorchock | 405/262 |
| 5,407,303 | A | * | 4/1995 | Manns | 405/262 |
| 5,417,523 | A | | 5/1995 | Scales | |
| 5,451,120 | A | | 9/1995 | Martinez-Gonzalez | |
| 5,456,554 | A | | 10/1995 | Barrett | |
| 5,474,405 | A | | 12/1995 | Anderson | |
| D366,191 | S | | 1/1996 | Gay | |
| 5,484,235 | A | * | 1/1996 | Hilfiker et al. | 405/284 |
| 5,487,623 | A | | 1/1996 | Anderson | |
| 5,494,379 | A | | 2/1996 | Anderson | |
| 5,507,599 | A | | 4/1996 | Anderson | |
| 5,522,682 | A | | 6/1996 | Egan | |
| 5,525,014 | A | * | 6/1996 | Brown | 405/262 |
| 5,531,547 | A | * | 7/1996 | Shimada | 405/262 |
| 5,533,839 | A | | 7/1996 | Shimada | |
| 5,568,998 | A | * | 10/1996 | Egan et al. | 405/262 |
| 5,582,492 | A | * | 12/1996 | Doyle, Jr. | 405/262 |
| 5,622,455 | A | | 4/1997 | Anderson | |
| 5,658,096 | A | * | 8/1997 | Von Kanel | 405/302.4 |
| 5,702,208 | A | | 12/1997 | Hilfiker | |
| 5,713,155 | A | * | 2/1998 | Prestele | 47/33 |
| 5,722,799 | A | * | 3/1998 | Hilfiker | 405/262 |
| 5,730,559 | A | | 3/1998 | Anderson | |
| 5,733,072 | A | * | 3/1998 | Hilfiker et al. | 405/284 |
| D393,989 | S | | 5/1998 | Groves | |
| 5,749,680 | A | * | 5/1998 | Hilfiker et al. | 405/262 |
| 5,797,706 | A | * | 8/1998 | Segrestin et al. | 405/262 |
| 5,807,030 | A | * | 9/1998 | Anderson et al. | 405/262 |
| 5,820,305 | A | | 10/1998 | Taylor | |
| 5,921,715 | A | * | 7/1999 | Rainey | 405/262 |
| 5,947,643 | A | * | 9/1999 | Anderson et al. | 405/262 |
| 5,951,209 | A | * | 9/1999 | Anderson et al. | 405/262 |
| 5,962,834 | A | * | 10/1999 | Markman | 235/385 |
| 5,965,467 | A | * | 10/1999 | Stevenson et al. | 442/218 |
| 5,971,699 | A | | 10/1999 | Winski | |
| 5,975,809 | A | | 11/1999 | Taylor | |
| 5,975,810 | A | | 11/1999 | Taylor | |
| 6,024,516 | A | | 2/2000 | Taylor | |
| 6,050,748 | A | | 4/2000 | Anderson | |
| 6,079,908 | A | * | 6/2000 | Anderson | 405/262 |
| 6,086,288 | A | * | 7/2000 | Ruel et al. | 405/262 |
| D433,291 | S | | 11/2000 | Shamoon | |
| 6,186,703 | B1 | * | 2/2001 | Shaw | 405/262 |
| 6,280,121 | B1 | * | 8/2001 | Khamis | 405/284 |
| 6,336,773 | B1 | * | 1/2002 | Anderson et al. | 405/262 |
| 6,345,934 | B1 | * | 2/2002 | Jailloux et al. | 405/262 |
| 6,357,970 | B1 | * | 3/2002 | Hilfiker et al. | 405/302.7 |
| 6,517,293 | B2 | * | 2/2003 | Taylor et al. | 405/302.4 |
| 6,565,288 | B1 | * | 5/2003 | McCallion | 405/259.5 |
| 6,595,726 | B1 | * | 7/2003 | Egan et al. | 405/284 |
| 6,675,547 | B1 | * | 1/2004 | Golcheh | 52/741.13 |
| 6,793,436 | B1 | * | 9/2004 | Ruel et al. | 403/316 |
| 6,802,675 | B2 | * | 10/2004 | Timmons et al. | 405/284 |
| 6,854,236 | B2 | * | 2/2005 | Bott | 52/609 |
| 6,857,823 | B1 | * | 2/2005 | Hilfiker et al. | 405/262 |
| 6,874,975 | B2 | * | 4/2005 | Hilfiker et al. | 405/262 |
| 6,939,087 | B2 | * | 9/2005 | Ruel | 405/286 |
| 7,033,118 | B2 | * | 4/2006 | Hilfiker | 405/262 |
| 7,073,983 | B2 | * | 7/2006 | Hilfiker et al. | 405/262 |
| 7,270,502 | B2 | | 9/2007 | Brown | |
| 7,281,882 | B2 | * | 10/2007 | Hilfiker et al. | 405/262 |
| 7,399,144 | B2 | | 7/2008 | Kallen | |
| D599,630 | S | | 9/2009 | Taylor | |
| 7,708,503 | B2 | * | 5/2010 | Kohel et al. | 405/302.7 |
| 7,722,296 | B1 | * | 5/2010 | Taylor | 405/262 |
| 7,891,912 | B2 | | 2/2011 | Taylor | |
| 7,972,086 | B2 | | 7/2011 | Taylor | |
| 7,980,790 | B2 | | 7/2011 | Taylor | |
| 8,079,782 | B1 | * | 12/2011 | Hilfiker et al. | 405/262 |
| 2002/0044840 | A1 | | 4/2002 | Taylor | |
| 2002/0067959 | A1 | | 6/2002 | Thornton | |
| 2003/0213203 | A1 | * | 11/2003 | Bott et al. | 52/603 |
| 2003/0223825 | A1 | | 12/2003 | Timmons | |
| 2004/0018061 | A1 | | 1/2004 | Jannsson | |
| 2004/0161306 | A1 | * | 8/2004 | Ruel | 405/284 |
| 2004/0179902 | A1 | * | 9/2004 | Ruel | 405/284 |
| 2005/0111921 | A1 | * | 5/2005 | Taylor et al. | 405/262 |
| 2005/0163574 | A1 | | 7/2005 | Hilfiker | |
| 2005/0260042 | A1 | * | 11/2005 | Kang | 405/302.7 |
| 2005/0271478 | A1 | * | 12/2005 | Ferraiolo | 405/284 |
| 2005/0286981 | A1 | * | 12/2005 | Robertson et al. | 405/284 |
| 2006/0204342 | A1 | * | 9/2006 | Hilfiker et al. | 405/262 |
| 2006/0204343 | A1 | * | 9/2006 | Kallen | 405/284 |
| 2006/0239783 | A1 | * | 10/2006 | Kallen | 405/284 |
| 2007/0014638 | A1 | | 1/2007 | Brown | |
| 2008/0308780 | A1 | * | 12/2008 | Sloan et al. | 256/31 |
| 2008/0315169 | A1 | * | 12/2008 | McNeill | 256/1 |
| 2009/0016825 | A1 | * | 1/2009 | Taylor | 405/284 |
| 2009/0067933 | A1 | | 3/2009 | Taylor | |
| 2009/0123238 | A1 | * | 5/2009 | Morizot et al. | 405/302.4 |
| 2009/0285639 | A1 | * | 11/2009 | Taylor et al. | 405/262 |
| 2009/0304456 | A1 | | 12/2009 | Taylor | |
| 2010/0247248 | A1 | | 9/2010 | Taylor | |
| 2010/0254770 | A1 | * | 10/2010 | Morizot et al. | 405/302.4 |
| 2011/0091290 | A1 | * | 4/2011 | Ridgway et al. | 405/284 |
| 2011/0170957 | A1 | | 7/2011 | Taylor | |
| 2011/0170958 | A1 | * | 7/2011 | Taylor | 405/262 |
| 2011/0170960 | A1 | | 7/2011 | Taylor | |
| 2011/0229274 | A1 | | 9/2011 | Taylor | |
| 2011/0311317 | A1 | | 12/2011 | Taylor | |
| 2011/0311318 | A1 | | 12/2011 | Taylor | |

FOREIGN PATENT DOCUMENTS

| | | |
|---|---|---|
| FR | 530097 | 9/1921 |
| FR | 1006087 | 1/1952 |

(56) References Cited

FOREIGN PATENT DOCUMENTS

| | | |
|---|---|---|
| JP | 3114014 | 6/1991 |
| JP | 08209703 | 8/1996 |
| JP | 08326074 | 12/1996 |
| KR | 1020080058697 | 6/2008 |
| KR | 1020100027693 | 3/2010 |
| WO | WO9413890 | 6/1994 |
| WO | WO2009009369 | 1/2009 |
| WO | WO2009140576 | 11/2009 |
| WO | WO2010082940 | 7/2010 |
| WO | WO2011084983 | 7/2011 |
| WO | WO2011084986 | 7/2011 |
| WO | WO2011084989 | 7/2011 |
| WO | WO2011127349 | 10/2011 |
| WO | WO2011059807 | 12/2011 |
| WO | WO2011159808 | 12/2011 |

OTHER PUBLICATIONS

International Application No. PCT/US09/031494—International Search Report and Written Opinion dated Mar. 13, 2009.
International Application No. PCT/US09/44099—International Search Report and Written Opinion dated Aug. 12, 2009.
International Application No. PCT/US08/069011—International Preliminary Report on Patentability dated Jan. 21, 2010.
International Application No. PCT/US10/036991—International Search Report and Written Opinion dated Aug. 2, 2010.
International Application No. PCT/US09/44099—International Preliminary Report on Patentability dated Nov. 25, 2010.
International Application No. PCT/US2010/036991—International Preliminary Examination Reported mailed Jul. 14, 2011.
International Application No. PCT/US09/0031494—International Preliminary Report on Patentability dated Jul. 19, 2011.
International Application No. PCT/US2010/036991—Corrected International Preliminary Examination Report mailed Aug. 15, 2011.
International Application No. PCT/US2011/031688—International Search Report and Written Opinion dated Nov. 30, 2011.
International Application No. PCT/US2011/040540—International Search Report and Written Opinion dated Feb. 17, 2012.
International Application No. PCT/US2011/040543—International Search Report and Written Opinion dated Feb. 21, 2012.
International Application No. PCT/US2011/040541—International Search Report and Written Opinion dated Feb. 27, 2012.
Webster's tenth edition, "Collegiate Dictionary", p. 423; 1998.

* cited by examiner

MECHANICALLY STABILIZED EARTH WELDED WIRE FACING CONNECTION SYSTEM AND METHOD

CROSS REFERENCE TO RELATED APPLICATIONS

The present application is a continuation-in-part of co-pending U.S. patent application Ser. No. 12/837,347, entitled "Mechanically Stabilized Earth Welded Wire Facing Connection System and Method," which was filed on Jul. 15, 2010, which in turn is a continuation-in-part of co-pending U.S. patent application Ser. No. 12/818,011, entitled "Mechanically Stabilized Earth System and Method," which was filed on Jun. 17, 2010. The contents of both applications are hereby incorporated by reference to the extent consistent with the disclosure.

BACKGROUND

Retaining wall structures that use horizontally positioned soil inclusions to reinforce an earth mass in combination with a facing element are referred to as mechanically stabilized earth (MSE) structures. MSE structures can be used for various applications including retaining walls, bridge abutments, dams, seawalls, and dikes.

The basic MSE implementation is a repetitive process where layers of backfill and horizontally-placed soil reinforcing elements are positioned one atop the other until a desired height of the earthen structure is achieved. Typically, grid-like steel mats or welded wire mesh are used as soil reinforcing elements. In most applications, the soil reinforcing elements consist of parallel, transversely-extending wires welded to parallel, longitudinally-extending wires, thus forming a grid-like mat or structure. Backfill material and the soil reinforcing mats are combined and compacted in series to form a solid earthen structure, taking the form of a standing earthen wall.

In some instances, the soil reinforcing elements can be attached or otherwise coupled to a substantially vertical wall either forming part of the MSE structure or offset a short distance therefrom. The vertical wall is typically made either of concrete or a steel wire facing and not only serves to provide tensile resistance to the soil reinforcing elements but also prevents erosion of the MSE. The soil reinforcing elements extending from the compacted backfill may be attached directly to a vertical wall of the facing in a variety of configurations.

Although there are several methods of attaching soil reinforcing elements to facing structures, it nonetheless remains desirable to find improved attachment methods and systems that provide greater resistance to shear forces inherent in such structures.

SUMMARY

Embodiments of the disclosure may provide a mechanically stabilized earth structure. The mechanically stabilized earth structure may include a wire facing having a bend formed therein to form a horizontal element and a vertical facing. The horizontal element may have initial and terminal wires each coupled to a plurality of horizontal wires, and the vertical facing may have a plurality of vertical wires coupled to a plurality of facing cross wires and a top-most cross wire. The mechanically stabilized earth structure may also include a soil reinforcing element having a plurality of transverse wires coupled to at least two longitudinal wires having lead ends that converge, and a connector configured to couple the soil reinforcing element to the wire facing. The connector may include a facing anchor including a plate defining a plate aperture and being integral with or coupled to an extension member configured such that at least a portion of the extension member is inserted through a grid spacing defined by the vertical facing whereby the facing anchor is coupled to the vertical facing. The connector may also include a connective stud including a first end forming a shaft configured to be coupled to the soil reinforcing element and a second end forming a first prong and a second prong, each extending axially from the shaft and offset from the other, such that a gap is defined therebetween. The connector may further include a coupling device configured to couple the facing anchor to the connective stud.

Embodiments of the disclosure may further provide a method of constructing a mechanically stabilized earth structure. The method may include providing a first lift including a first wire facing being bent to form a first horizontal element and a first vertical facing. The first horizontal element may have initial and terminal wires coupled to a plurality of horizontal wires, and the first vertical facing may have a plurality of vertical wires coupled to a plurality of facing cross wires including a last facing cross wire and a top-most cross wire. The method may also include inserting an extension member of a facing anchor including a plate and the extension member through the first vertical facing, and disposing one or more arms coupled to or integral with the extension member in a substantially horizontal disposition, such that the one or more arms prohibit the extension member from passing back through the first vertical facing. The method may further include coupling a plurality of converging lead ends of longitudinal wires of a first soil reinforcing element to a shaft of a connection stud including a first end forming the shaft and a second end forming a first prong and a second prong, each extending axially from the shaft and further being offset from each other, such that a gap is defined therebetween. The method may also include disposing the plate defining a plate aperture within the gap, such that a first prong opening defined by the first prong and a second prong opening defined by the second prong are each co-aligned with the plate aperture, and inserting a bolt therethrough the co-aligned first prong opening, second prong opening, and plate aperture and coupling a nut to the bolt, such that the facing anchor is coupled to the connection stud. The method may further include placing a screen on the first wire facing whereby the screen covers at least a portion of the first vertical facing and first horizontal element, and placing backfill on the first lift to a first height above the last facing cross wire of the first vertical facing, such that the first height is below the top-most cross wire.

Embodiments of the disclosure may further provide another mechanically stabilized earth structure. The mechanically stabilized earth structure may include a wire facing having a bend formed therein to form a horizontal element and a vertical facing. The horizontal element may have initial and terminal wires each coupled to a plurality of horizontal wires, and the vertical facing may have a plurality of vertical wires coupled to a plurality of facing cross wires and a top-most cross wire. The mechanically stabilized earth structure may also include a soil reinforcing element having a plurality of transverse wires coupled to at least two longitudinal wires having lead ends that terminate substantially parallel to one another, and a connector configured to couple the soil reinforcing element to the wire facing. The connector may include a facing anchor including a continuous wire bent about 180 degrees back about itself about a center section of the continuous wire. The facing anchor may include a coupling section forming a protrusion configured to extend through a grid opening defined by the plurality of transverse wires coupled to the at least two longitudinal wires, and an anchor section including a convergent section formed from the continuous wire converging from the protrusion and a pair of arms extending tangentially from the convergent section. The pair of arms may be configured to be inserted through the vertical facing such that the facing anchor is coupled to the vertical facing. The connector may also include a coupling device configured to be inserted between a spacing defined between the protrusion and the soil reinforcing element, thereby coupling the soil reinforcing element to the facing anchor and the vertical facing.

Embodiments of the disclosure may further provide another method for constructing a mechanically stabilized earth structure. The method may include providing a first lift including a first wire facing being bent to form a first horizontal element and a first vertical facing. The first horizontal element may have initial and terminal wires coupled to a plurality of horizontal wires, and the first vertical facing may have a plurality of vertical wires coupled to a plurality of facing cross wires including a last facing cross wire and a top-most cross wire. The method may also include applying a force to a convergent section of a facing anchor formed from a continuous wire bent about 180 degrees back about itself about a center section of the continuous wire, the force causing a width of the convergent section to be less than a distance between two adjacent vertical wires of the plurality of vertical wires. The method may further include inserting the facing anchor through the two adjacent vertical wires such that a pair of arms extending tangentially from the convergent section are substantially vertically disposed, and rotating the facing anchor about ninety degrees, such that the pair of arms are substantially horizontally disposed and are further disposed on an opposing side of the vertical facing from a protrusion formed in a coupling section of the facing anchor, such that the arms are prohibited from returning through the two adjacent vertical wires. The method may also include removing the force applied to the convergent section, such that the width of the convergent section is at least substantially equal to the distance between the two adjacent vertical wires, and extending the protrusion through a grid opening formed from a pair of substantially parallel lead ends of longitudinal wires coupled to at least two adjacent transverse wires of a first soil reinforcing element. The method may also include extending a coupling device through a space formed beneath the protrusion and above the pair of substantially parallel lead ends of longitudinal wires such that the soil reinforcing element is coupled to the facing anchor, and placing a screen on the first wire facing whereby the screen covers at least a portion of the first vertical facing and first horizontal element. The method may further include placing backfill on the first lift to a first height above the last facing cross wire of the first vertical facing, such that the first height is below the top-most cross wire.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
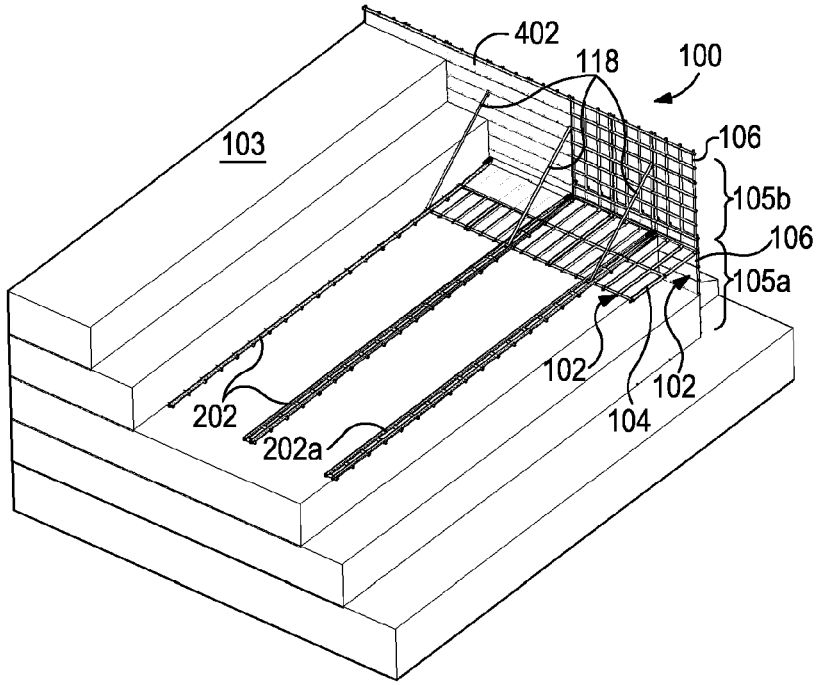
FIG. 1 is an isometric view of an exemplary system of constructing a mechanically stabilized earth structure, according to one or more aspects of the present disclosure.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Referring to FIG. 1, illustrated is an isometric view of an exemplary system 100 for erecting an MSE structure. In brief, and as will be described in more detail below, the system 100 may include one or more wire facings 102 stacked one atop the other and having one or more soil reinforcing elements 202,202*a* coupled thereto. One or more struts 118 may also be coupled to each wire facing 102 and adapted to maintain each wire facing 102 in a predetermined angular configuration; however, embodiments in which the wire facing 102 is maintained in a predetermined angular configuration by any other manner known to those of ordinary skill in the art are also contemplated herein. Backfill 103 may be sequentially added to the system 100 in a plurality of layers configured to cover the soil reinforcing elements 202, thereby providing tensile strength to the wire facings 102 and preventing the wire facings 102 from bulging outward. A more detailed discussion of these and other elements of the system 100 now follows.

Figure 2A:
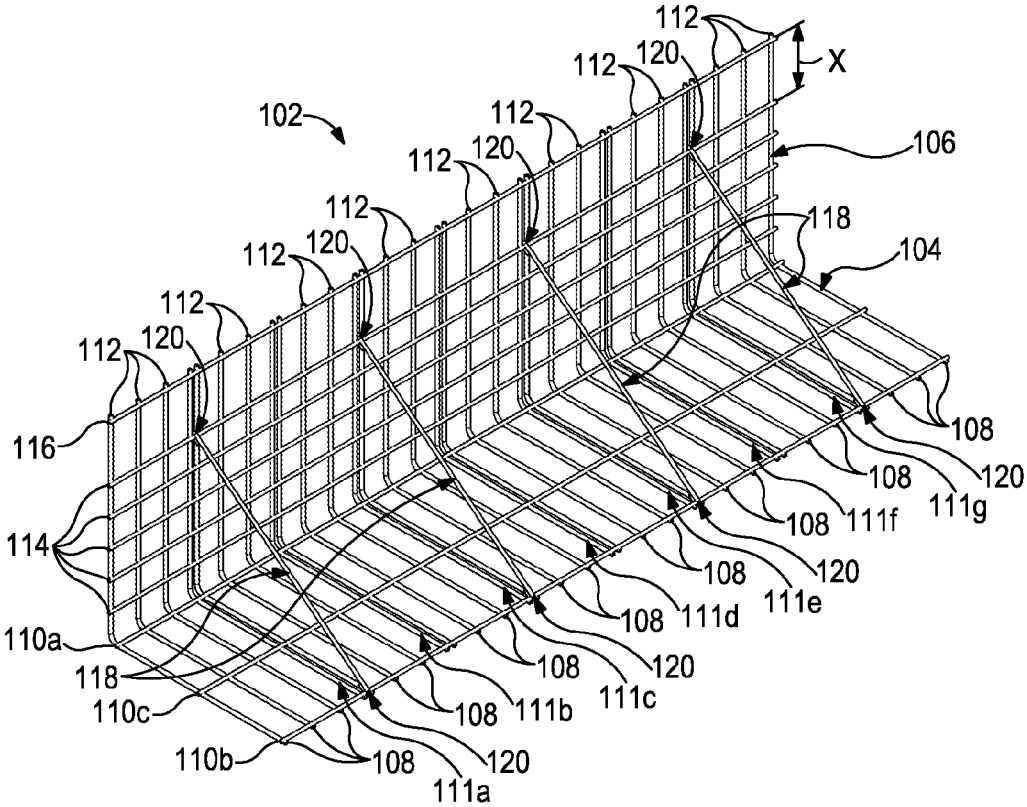
FIG. 2A is an isometric view of an exemplary wire facing element, according to one or more aspects of the present disclosure.
Figure 2B:
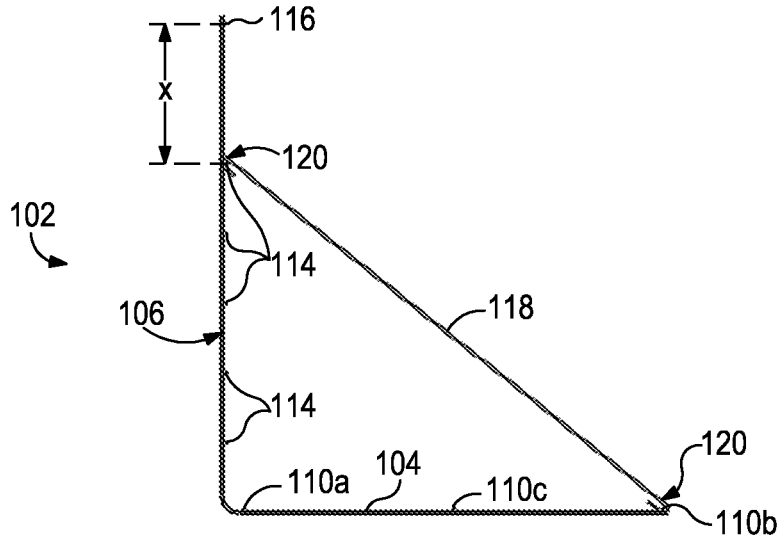
FIG. 2B is a side view of the wire facing element shown in FIG. 2A.

Referring to FIGS. 2A and 2B, each wire facing 102 of the system 100 may be fabricated from several lengths of cold-drawn wire welded and arranged into a mesh panel. The wire mesh panel can then be folded or otherwise shaped to form a substantially L-shaped assembly including a horizontal element 104 and a vertical facing 106. The horizontal element 104 may include a plurality of horizontal wires 108 welded or otherwise attached to one or more cross wires 110, such as an initial wire 110*a*, a terminal wire 110*b*, and a median wire 110*c*. The initial wire 110*a* may be disposed adjacent to and directly behind the vertical facing 106, thereby being positioned inside the MSE structure. The terminal wire 110*b* may be disposed at or near the distal ends of the horizontal wires 108. The median wire 110*c* may be welded or otherwise coupled to the horizontal wires 108 and disposed laterally between the initial and terminal wires 110*a,b*. As can be appreciated, any number of cross wires 110 can be employed without departing from the scope of the disclosure. For instance, in at least one embodiment, the median wire 110*c* may be excluded from the system 100.

The vertical facing 106 can include a plurality of vertical wires 112 extending vertically with reference to the horizontal element 104 and laterally-spaced from each other. In one embodiment, the vertical wires 112 may be vertically-extending extensions of the horizontal wires 108. The vertical facing 106 may also include a plurality of facing cross wires 114 vertically-offset from each other and welded or otherwise attached to the vertical wires 112. A top-most cross wire 116 may be vertically-offset from the last facing cross wire 114 and also attached to the vertical wires 112 in like manner.

In at least one embodiment, each vertical wire 112 may be separated by a distance of about 4 inches on center from adjacent vertical wires 112, and the facing cross wires 114 may also be separated from each other by a distance of about 4 inches on center, thereby generating a grid-like facing composed of a plurality of square voids having about a 4"×4" dimension. As can be appreciated, however, the spacing between adjacent wires 112, 114 can be varied to more or less than 4 inches to suit varying applications and the spacing need not be equidistant. In one embodiment, the top-most cross wire 116 may be vertically-offset from the last facing cross wire 114 by a distance X, as will be discussed in more detail below.

The wire facing 102 may further include a plurality of connector leads 111*a-g* extending from the horizontal element 104 and up the vertical facing 106. In an embodiment, each connector lead 111*a-g* may include a pair of horizontal wires 108 (or vertical wires 112, if taken from the frame of reference of the vertical facing 106) laterally-offset from each other by a short distance. The short distance can vary depending on the particular application, but may generally include about a one inch separation. In one embodiment, each connector lead 111*a-g* may be equidistantly-spaced from each other along the horizontal element 104 and/or vertical facing 106, and configured to provide a visual indicator to an installer as to where a soil reinforcing element 202,202*a* (FIGS. 1 and 3A-3D) may be properly attached, as will be described in greater detail below. In at least one embodiment, each connector lead 111*a-g* may be spaced from each other by about 12 inches on center. As can be appreciated, however, such relative distances may vary to suit particular applications.

In one or more embodiments, the cross wires 110*a-c* of the horizontal element 104 may be larger in diameter than the cross wires 114 and top-most cross wire 116 of the vertical facing 106. In at least one embodiment, the cross wires 110*a-c* of the horizontal element 104 may have diameters at least twice as large as the facing cross wires 114 and top-most cross wire 116 of the vertical facing 106. In other embodiments, however, the diameter of wires 110*a-c*, 114, 116 may be substantially the same or the facing cross wires 114 may be larger than the cross wires 110*a-c* of the horizontal element 104 without departing from the scope of the disclosure.

Still referring to FIGS. 2A-2B, one or more struts 118 may be operatively coupled to the wire facing 102. As illustrated, the struts 118 may be coupled to both the vertical facing 106 and the horizontal element 104 at appropriate locations. Each strut 118 may be prefabricated with or include a connection device 120 disposed at each end of the strut 118 and configured to fasten or otherwise attach the struts 118 to both the horizontal element 104 and the vertical facing 106. In at least one embodiment, and as can best be seen in FIG. 5, the connection device 120 may include a hook that is bent about 180° back upon itself. In other embodiments, the connection device 120 may include a wire loop disposed at each end of the struts 118 that can be manipulated, clipped, or otherwise tied to both the horizontal element 104 and the vertical facing 106. As can be appreciated, however, the struts 118 can be coupled to the horizontal element 104 and the vertical facing 106 by any practicable method or device known in the art.

Each strut 118 may be coupled at one end to at least one facing cross wire 114 and at the other end to the terminal wire 110*b*. In other embodiments, one or more struts 118 may be coupled to the median wire 110*c* instead of the terminal wire 110*b*, without departing from the scope of the disclosure. As illustrated, each strut 118 may be coupled to the wire facing 102 in general alignment with a corresponding connector lead 111*a-g*. In other embodiments, however, the struts 118 can be connected at any location along the respective axial lengths of any facing cross wire 114 and terminal wire 110*b*, without departing from the scope of the disclosure. In yet other embodiments, the struts 118 may be coupled to a vertical wire 112 of the vertical facing 106 and/or a horizontal wire 108 of the horizontal element 104, respectively, without departing from the scope of the disclosure.

The struts 118 are generally coupled to the wire facing 102 before any backfill 103 (FIG. 1) is added to the respective layer of the system 100. During the placement of backfill 103, and during the life of the system 100, the struts 118 may be adapted to prevent the vertical facing 106 from bending past a predetermined vertical angle. For example, in the illustrated embodiment, the struts 118 may be configured to maintain the vertical facing 106 at or near about 90° with respect to the horizontal element 104. As can be appreciated, however, the struts 118 can be fabricated to varying lengths or otherwise attached at varying locations along the wire facing 102 to maintain the vertical facing 106 at a variety of angles of orientation. The struts 118 may allow installers to walk on the backfill 103 of the MSE structure, tamp it, and compact it fully before adding a new lift or layer, as will be described below.

Referring now to FIGS. 3A through 3D, illustrated are exemplary soil reinforcing elements 202,202*a* that may be attached or otherwise coupled to a portion of the wire facing 102 (FIGS. 2A and 2B) in the construction of an MSE structure. The soil reinforcing element 202,202*a* may include a welded wire grid having a pair of longitudinal wires 204 that extend substantially parallel to each other. In other embodiments, there could be more than two longitudinal wires 204 without departing from the scope of the disclosure. The longitudinal wires 204 may be joined to one or more transverse wires 206 in a generally perpendicular fashion by welds at their intersections, thus forming a welded wire gridworks. In one or more embodiments, the spacing between each longitudinal wire 204 may be about 2 inches, while the spacing between each transverse wire 206 (see also FIG. 4) may be about 6 inches. As can be appreciated, however, the spacing and configuration of adjacent respective wires 204, 206 may vary for a variety of reasons, such as the combination of tensile force requirements that the soil reinforcing element 202,202*a* must endure and resist. In other embodiments, the soil reinforcing element 202,202*a* may include more or less than two longitudinal wires 106 without departing from the scope of the disclosure.

Figure 3A:
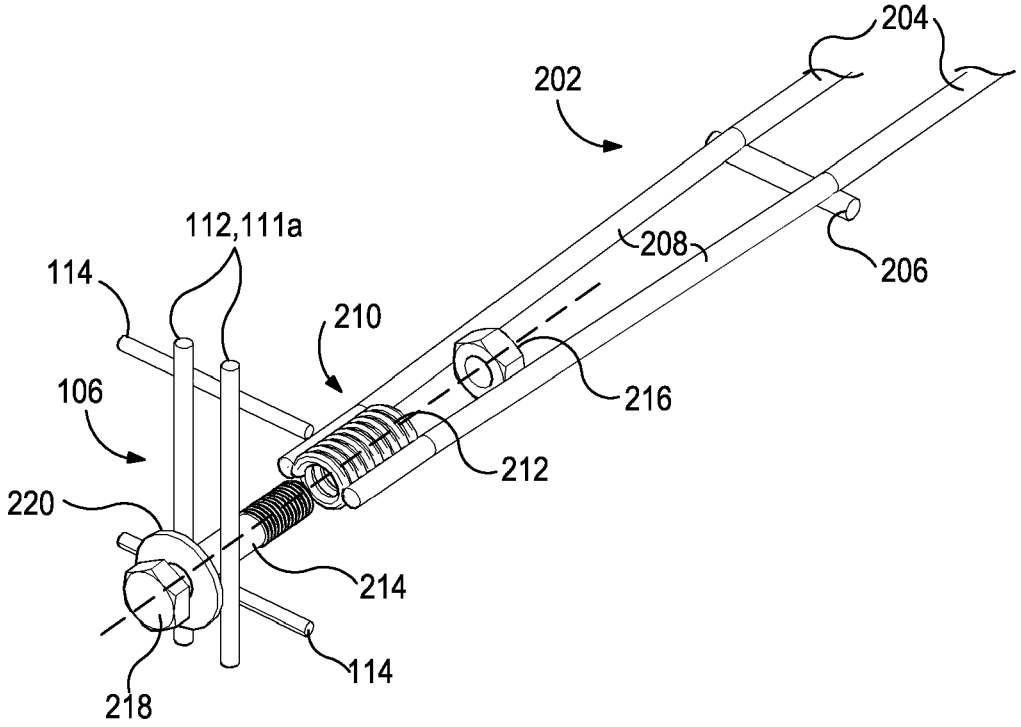
FIG. 3A is an isometric view of a connector and soil reinforcing element used in the system shown in FIG. 1, according to one or more aspects of the present disclosure.
Figure 3B:
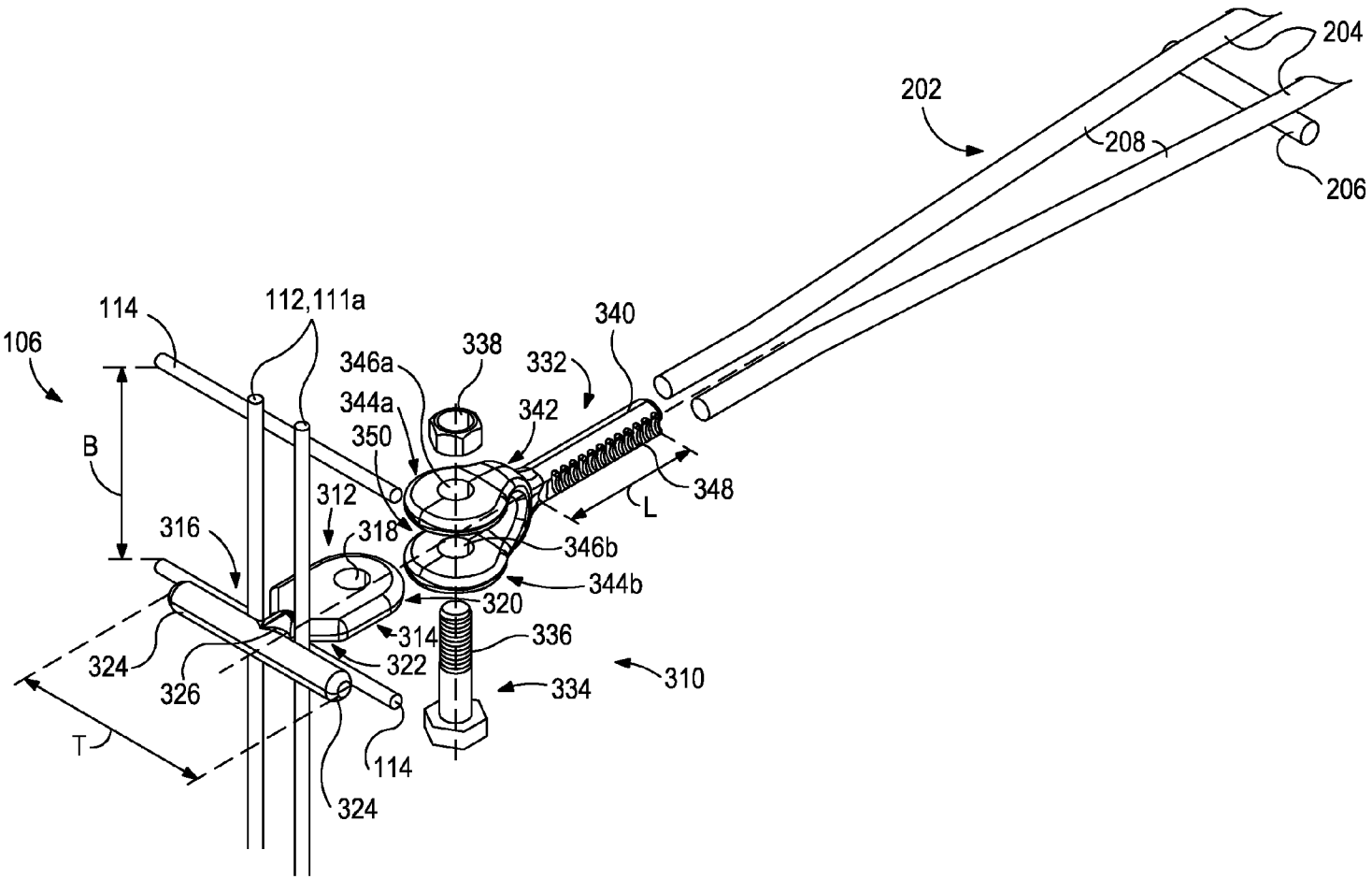
FIG. 3B is an isometric view of another connector and soil reinforcing element used in the system shown in FIG. 1, according to one or more aspects of the present disclosure.
Figure 3C:
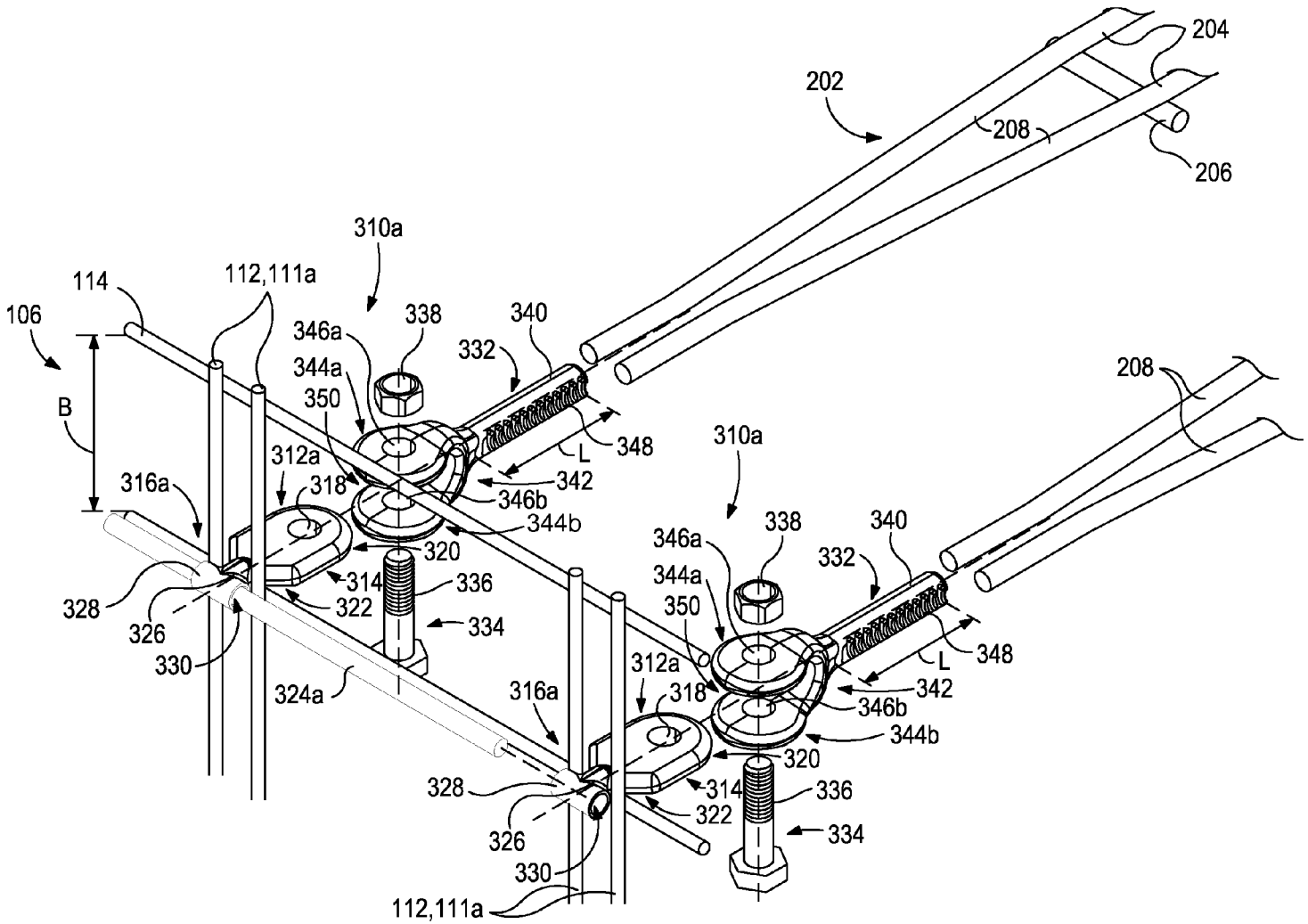
FIG. 3C is an isometric view of a plurality of connectors and soil reinforcing elements used in the system shown in FIG. 1, according to one or more aspects of the present disclosure.

In one or more embodiments, lead ends 208 of the longitudinal wires 204 of the soil reinforcing element 202 may generally converge and be welded or otherwise attached to a connector 210,310,310*a* as illustrated in FIGS. 3A, 3B, and 3C, respectively. In another embodiment shown in FIG. 3D, the lead ends 208 of the longitudinal wires 204 of the soil reinforcing element 202*a* may terminate substantially parallel to each other. The lead ends 208 may be connected by a pair of transverse wires 206 longitudinally offset from each other and disposed in a generally perpendicular fashion to the longitudinal wires 204. The transverse wires 206 may be joined to each longitudinal wire 204 by welds at their respective intersections. The pair of transverse wires 206 are further longitudinally offset such that a protrusion or crimp 420 formed in a facing anchor 412 of a connector 410 may be inserted through a grid opening 422 defined by the lead ends 208 and the longitudinally offset pair of transverse wires 206, which will be discussed further below.

In at least one embodiment shown in FIG. 3A, the connector 210 (shown in an exploded view for ease of viewing) may include a coil 212, a threaded rod 214, such as a bolt or a length of rebar, and a nut 216. As illustrated, the coil 212 may include a plurality of indentations or grooves defined along its axial length which provide a more suitable welding surface for attaching the lead ends 208 of the longitudinal wires 204 thereto. As can be appreciated, such indentations and/or grooves can result in a stronger resistance weld. In one embodiment, the coil 212 can be a compressed coil spring. In other embodiments, the coil 212 can be another nut or a coil rod that is welded to the longitudinal wires 204. Other exemplary embodiments of the connector 210 contemplated herein are described in co-owned U.S. Pat. No. 6,517,293, entitled "Anchor Grid Connector Element," issued on Feb. 11, 2003 and hereby incorporated by reference to the extent not inconsistent with the present disclosure.

To secure the soil reinforcing element 202 to a portion of the wire facing 102 (FIG. 2B), or more particularly the vertical facing 106, the head 218 of the threaded rod 214 may be disposed on the front side of at least two vertical wires 112, such as at a connector lead 111*a*. The body of the threaded rod 214 can be extended through the vertical facing 106 and coil 212 and secured thereto with the nut 216 at its end. As illustrated, the head 218 may be prevented from passing through the vertical wires 112 or connector lead 111*a* by employing a washer 220 disposed radially about the threaded rod and adapted to provide a biasing engagement with the vertical wires 112 or connector lead 111*a*. As the nut 216 is tightened, it brings the coil 212 into engagement, or at least adjacent to, the back side of the vertical facing 106.

In embodiments where the lateral spacing of adjacent vertical wires 112 is such that the connector 210 and a portion of the soil reinforcing element 202 may be able to extend through the vertical facing 106, it is further contemplated to employ secondary washers or bearing plates (not shown) on the inside or back side of the vertical facing 106. For instance, at least one secondary washer or bearing plate may extend radially around the threaded rod and be disposed axially adjacent the coil 212 and large enough so as to bear on at least two vertical wires 112 and prevent the connector 210 from passing through the vertical facing 106. Accordingly, the soil reinforcing element 202 may be secured against removal from the wire facing 102 on both front and back sides of the vertical facing 106.

In another embodiment illustrated in FIG. 3B, the connector 310 (shown in an exploded view for ease of viewing) may include a facing anchor 312 including a plate 314 integral with or coupled to an extension member forming a generally T-shape member 316. The plate 314 defines a plate aperture 318 in a first end section 320 distal to a second end section 322 of the plate 314 integral with or coupled to the generally T-shape member 316. In the embodiments shown in FIGS. 3B and 3C, the first end section 320 of the plate 314 forms a generally arcuate end section configured to assist in rotation of the soil reinforcing element 202 in the horizontal plane, as generally indicated by arrows A in FIG. 4, which will be discussed further below. The second end section 322 of the plate 314 forms a beveled or tapered end section terminating in the generally T-shape member 316. The beveled end section 322 may be configured as such to assist in the vertical movement of the connector 310,310*c* in relation to the vertical facing 106, which will be discussed further below. In an exemplary embodiment, the facing anchor 312 may be formed from steel. In another embodiment, the facing anchor 312 may be formed from metal, plastic, or the like.

In an exemplary embodiment shown in FIG. 3B, the generally T-shape member 316 includes a pair of arms 324, each arm 324 extending in an opposing direction from a center member 326 of the generally T-shape member 316. In one or more embodiments, such as the embodiment illustrated in FIG. 3B, the arms 324 may be integral with the generally T-shape member 316. In another embodiment, the arms 324 may be coupled to the generally T-shape member 316. In yet another embodiment, shown in FIG. 3C, an arm housing 328 integral with and perpendicularly disposed to the center member 326 of a generally T-shape 316*a* member forms a bore 330 therethrough and is configured to receive one or more anchor pins or arms 324*a*.

As shown in FIGS. 3B and 3C, the connector 310,310*a* further includes a connection stud 332, and a coupling device, such as a nut and bolt assembly 334. The nut and bolt assembly 334 includes a bolt 336 configured to be inserted therethrough the plate aperture 318 and coupled to a nut 338, such that the connection stud 332 may be coupled to the facing anchor 312,312*a*. As illustrated, the connection stud 332 may be a dual-prong connection stud including a first end forming a shaft or stem 340 coupled to a second end or tab 342. As illustrated, the tab 342 may include a pair of prongs 344*a*, 344*b* vertically offset from each other and extending axially from the stem 340. Each prong 344*a,b* may define a centrally-disposed opening 346*a,b* used for connecting the dual-prong connection stud 332 to the facing anchor 312,312*a* (FIG. 3C), as will be described below. Each opening 346*a* may be coaxially aligned with the opposing opening 346*b*. The dual-prong connection stud 332 can be created via a one-piece forging process or, alternatively, the stem 340 can be welded or otherwise attached to the tab 342 via processes known to those skilled in the art.

As illustrated in FIGS. 3B and 3C, the stem 340 may include a plurality of indentations or grooves 348 defined, cast, or otherwise machined along its axial length L. In at least one embodiment, the grooves 348 can include standard thread markings machined along the axial length L. In other embodiments, the stem 340 may include axial channels (not shown). The grooves 348 may provide a more solid resistance weld surface for attaching the lead ends 208 of the longitudinal wires 204 thereto.

Referring to FIG. 3B, to secure the soil reinforcing element 202 to a portion of the wire facing 102 (FIG. 2B), or more particularly the vertical facing 106, the facing anchor 312 may be oriented such that the plate 314 and the generally T-shape member 316 including the arms 324 are substantially vertically disposed. The arms 324 of the generally T-shape member 316 may be inserted through the spacing between the vertical wires 112 or connector lead 111*a* from the side of the vertical facing 106 facing the horizontal element 104 (FIG. 2B) and subsequently rotated about ninety degrees, such that the generally T-shape member 316 is oriented in a substantially horizontal position and at least the arms 324 of the generally T-shape member 316 are disposed on the side of the vertical facing 106 opposing the horizontal element 104. In such an embodiment, the total length T of the arms 324 as extended may be less than a distance, indicated by arrow B, between the adjacent cross wires 114 through which the arms 324 are extended when vertically disposed. As noted above, the distance B may be a distance of about 4 inches on center from adjacent cross wires 114. However, as noted above, the distance B may vary based on the application, and accordingly, the total length T of the arms 324 may vary to correspond with the distance B between applicable cross wires 114.

In another embodiment, the total length T of the arms 324 as extended may be greater than the distance B between the adjacent cross wires 114 through which the arms 324 are extended when vertically disposed. In such an embodiment, a portion (e.g., one of the arms 324) of the arms 324 may be inserted through the spacing between the vertical wires 112 or connector lead 111*a* from the side of the vertical facing 106 facing the horizontal element 104 (FIG. 2B) and manipulated in a vertical, forward, backward, or combination thereof direction, and subsequently rotated about ninety degrees, such that the generally T-shape member 316 is oriented in a substantially horizontal position and at least the arms 324 of the generally T-shape member 316 are disposed on the side of the vertical facing 106 opposing the horizontal element 104.

Conversely, in an exemplary embodiment, the total length T of the arms 324 as extended in the horizontal orientation may be greater than the distance between the vertical wires 112 or connector lead 111*a*, such that the arms 324 may prohibit the movement of the generally T-shape member 316 from traveling back through the vertical facing 106. As noted above, this distance may vary depending on the particular application, but may generally include about a one inch separation. Embodiments in which the plate 316 may be substantially vertically disposed, inserted between the vertical wires 112 or connector lead 111*a* from the side of the vertical facing 106 opposing the horizontal element 104, and subsequently rotated about ninety degrees such the plate 314 is horizontally disposed on an opposing side of the vertical facing 106 from the generally T-shape member 316 are also contemplated herein.

Referring to FIG. 3C, the soil reinforcing element 202 may be secured to a portion of the wire facing 102, or more particularly the vertical facing 106, such that a plurality of soil reinforcing elements 202 may be connected in tandem. In the illustrated embodiment of FIG. 3C, a plurality of connectors 310*a* are secured to the vertical facing 106, each including a facing anchor 312*a* including a plate 314 integral with or coupled to the generally T-shape member 316*a*. The generally T-shape member 316*a* may include the arm housing 328 integral with and perpendicularly disposed to the center member 326 and forming therethrough the bore 330 configured to receive one or more of the anchor pins or arms 324*a*. In an exemplary embodiment, the facing anchor 312*a* may be formed from steel. In another embodiment, the facing anchor 312*a* may be formed from metal, plastic, or the like.

To secure each of the facing anchors 312*a* to the vertical facing 106, the generally T-shape member 316*a* including the arm housing 328 may be inserted between the vertical wires 112 or connector lead 111*a* from the side of the vertical facing 106 facing the horizontal element 104 (FIG. 2B). A continuous arm 324*a* or anchor pin may be received through each of the bores 330 of the arm housings 328 of the generally T-shape members 316*a* disposed on the side of the vertical facing 106 opposing the horizontal element 104, such that the arm 324*a* prohibits each of the generally T-shape members 316*a* from traveling back through the spacing between the vertical wires 112 or connector lead 111*a*.

The arm 324*a* or anchor pin may be a continuous length of rebar, round stock, a threaded rod, or other similar mechanism conveying similar mechanical properties, configured to be received through each of the bores 330 of the facing anchors 312*a*. In such a configuration, each of the facing anchors 312*a* may be connected in tandem. However, it will be appreciated by one of ordinary skill in the art that the plurality of facing anchors 312*a* may not be interconnected by the arm 324*a* in one or more embodiments. For example, in another embodiment, each bore 330 may receive a respective arm 324*a* or anchor pin therethrough, such that each of the respective arms 324*a* may be greater in length than the distance between the vertical wires 112 or connector lead 111*a*. As noted above, this distance may vary depending on the particular application, but may generally include about a one inch separation.

In the exemplary embodiments of FIGS. 3B and 3C, after rotation of the facing anchor 312 to the substantially horizontal position (FIG. 3B) or the insertion of the one or more arms 324*a* through the respective bores 330 of the facing anchor 312*a* (FIG. 3C), the arms 324,324*a* of the generally T-shape member 316,316*a* may prohibit the generally T-shape member 316,316*a* from traveling back between the vertical wires 112 or connector lead 111*a*. Accordingly, the plate 316 of the facing anchor 312,312*a* may be disposed in a horizontal orientation on the opposing side of the vertical facing 106 as to the arms 324,234*a* of the generally T-shape member 316, 316*a*. Although the facing anchor 312,312*a* may be prohibited from traveling between the vertical wires 112 or connector lead 111*a*, the facing anchor 312,312*a* is permitted to freely move in the vertical direction denoted by arrow B in FIGS. 3B and 3C between adjacent cross wires 114. In the illustrated embodiment of FIG. 3C, in which the facing anchors 312*a* are connected in tandem, the facing anchors 312*a* as a connected unit are permitted to freely move in the vertical direction B between adjacent cross wires 114.

As shown in FIGS. 3B and 3C, the soil reinforcing element 202 may be coupled to the connection stud 332. The lead ends 208 of the longitudinal wires 204 converge and are coupled to opposing sides of the stem 340. In an exemplary embodiment, the lead ends 208 may be welded to the stem 340. The stem 340 may include grooves 348, which may provide a more solid resistance weld surface for attaching the lead ends 208 of the longitudinal wires 204 thereto.

In the exemplary embodiments of FIGS. 3B and 3C, the prongs 344*a,b* of the tab 342 may be oriented, such that the first end section 320 of the plate 316 is disposed within the gap 350 defined between prongs 344*a,b*, and the openings 346*a,b* are substantially aligned with the plate aperture 318 of the first end section 320 of the plate 316. The coupling device, such as the nut and bolt assembly 334, may be used to secure the dual-prong connection stud 332 (and thus the soil reinforcing element 202) to the facing anchor 312,312*a*. The bolt 336 may be inserted through the aligned openings 346*a,b* and plate aperture 318 and coupled to the nut 338, thereby securing the soil reinforcing element 202 to the vertical facing 106.

Figure 4:
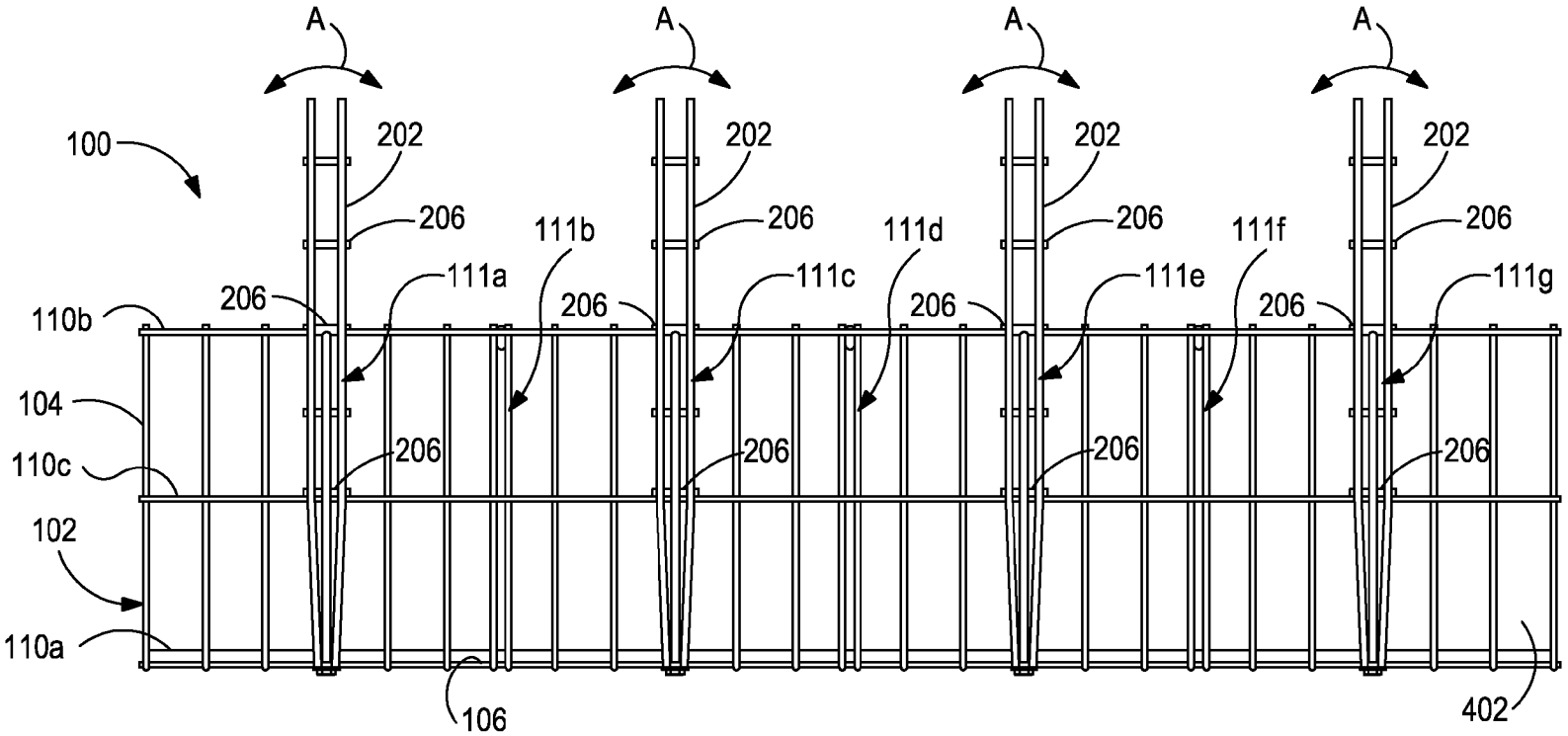
FIG. 4 is a plan view of the system of constructing a mechanically stabilized earth structure, according to one or more aspects of the present disclosure.

As secured to the facing anchor 312,312*a*, the dual-prong connection stud 332 may be free to swivel or rotate about the horizontal plane as denoted by arrow A in FIG. 4. The arcuate section of the first end section 320 provides an increased direction of travel for the soil reinforcing element 202 in the horizontal plane. The facing anchor 312,312*a* may be free to move vertically up and down the vertical facing 106 a vertical direction B between the corresponding cross wires 114. Additionally, the soil reinforcing mechanism may move a vertical distance D corresponding to the offset between the prongs 344*a*,344*b* and plate 316. The beveled section of the second end section 322 facilitates vertical travel of the facing anchor 312,312*a* by reducing frictional contact of the facing anchor 312,312*a* with the vertical wires 112. Allowing the facing anchor 312,312*a* to move freely in the vertical direction permits for potential backfill 104 settling or other MSE mechanical/natural phenomena, whereas allowing the facing anchor 312,312*a* to move freely in the horizontal direction provides for the ability of the soil reinforcing elements to avoid vertically-disposed obstructions.

Figure 3D:
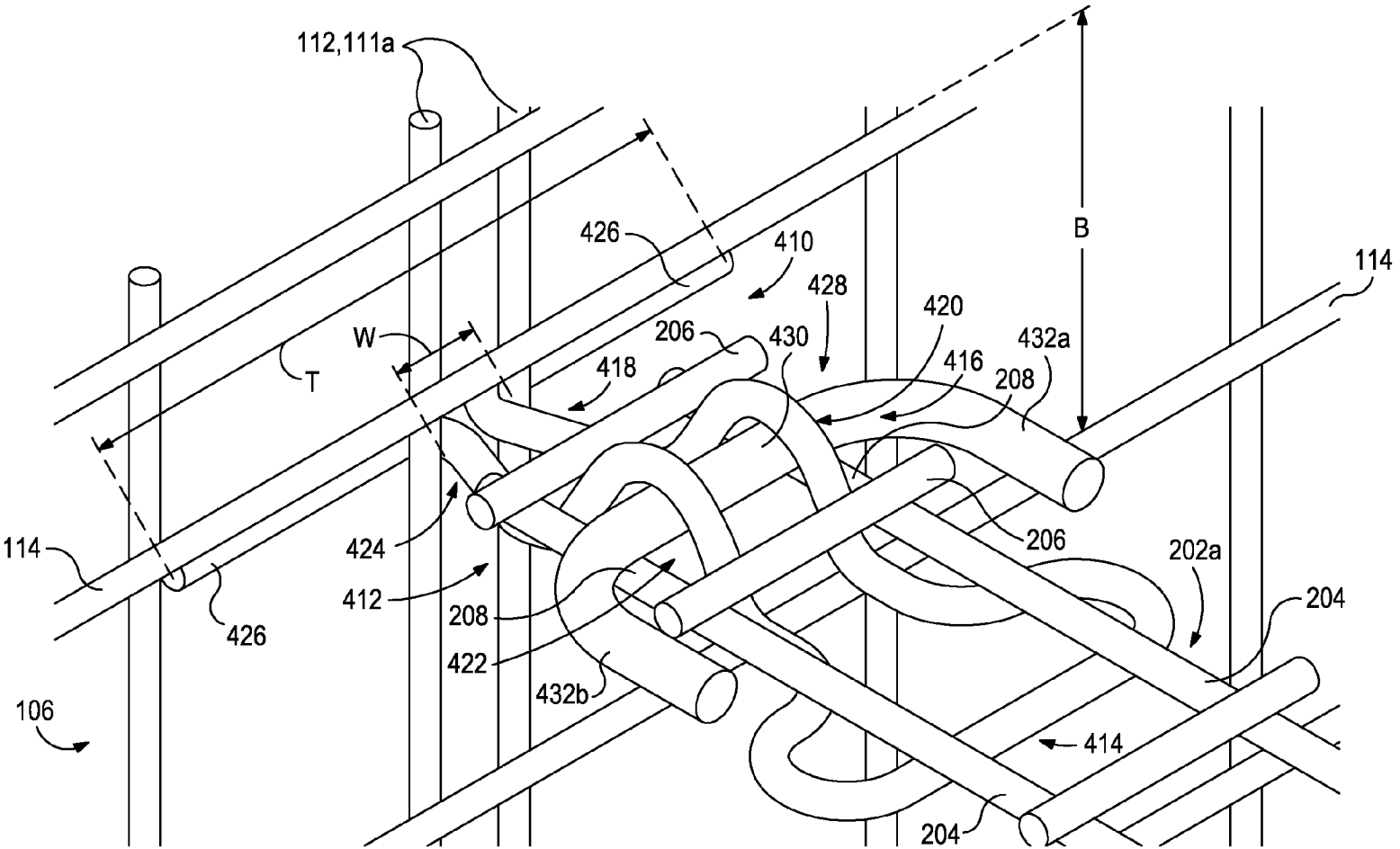
FIG. 3D is an isometric view of another connector and soil reinforcing element used in the system shown in FIG. 1, according to one or more aspects of the present disclosure.

Referring now to another embodiment illustrated in FIG. 3D, the connector 410 may include a facing anchor 412 formed by an unbroken length of continuous wire. In an exemplary embodiment, the continuous wire may include steel. In another embodiment, the continuous wire may include metal, plastic, or the like. The facing anchor 412 may be configured from the continuous wire being folded back about 180° upon itself about a center or midsection of the continuous wire. In an exemplary embodiment illustrated in FIG. 3D, the facing anchor 412 may be configured from the continuous wire being folded back about 180° upon itself such that a projection 414 is formed about the center or midsection of the continuous wire. The facing anchor 412 may include a coupling section 416 and an anchor section 418. The coupling section 416 may form the crimp 420 configured to extend through the grid opening 422 formed between the generally perpendicular transverse wires 206 coupled to the lead ends 208 of the longitudinal wires 204 of the soil reinforcing element 202*a*. The anchor section 418 includes a converging section 424 formed from the folded back continuous wire converging upon itself from the crimp 420 before extending tangentially and terminating with a pair of lateral extensions or arms 426.

The folded back continuous wire provides the anchor section 418 with a spring-like characteristic such that the converging section 424 of the anchor section 418 may be moved inward (providing greater convergence) with the application of force and allowed to expand outward (returning to equilibrium) when the force is removed. Accordingly, the converging section 424 of the anchor section 418, in an exemplary embodiment, is substantially equal to or greater in width, W, than the spacing between the vertical wires 112 or connector lead 111*a*. However, when a force is applied to the converging section 424, the width W may be decreased such that width W is less than the spacing between the vertical wires 112 or connector lead 111*a*.

Referring to FIG. 3D, to secure the soil reinforcing element 202*a* to a portion of the wire facing 102 (FIG. 2B), or more particularly the vertical facing 106, the facing anchor 412 may be oriented such that the anchor section 418 including the arms 426 are vertically disposed. A force may be applied to the converging section 424, forcing the wire of the converging section 424 to be moved inward such that the width W of the converging section 424 is less than the spacing between the vertical wires 112 or connector lead 111*a*. The arms 426 of the anchor section 418 may be inserted between the vertical wires 112 or connector lead 111*a* from the side of the vertical facing 106 facing the horizontal element 104, and subsequently rotated ninety degrees, such that the anchor section 418 is oriented in a substantially horizontal position and at least the arms 426 are disposed on the side of the vertical facing 106 opposing the horizontal element 104 (FIG. 2B). The force is then removed from the converging section 424 such that the converging section 424 expands outward and contacts the vertical wires 112 or connector lead 111*a*. Although the facing anchor 412 may be prohibited from traveling between the vertical wires 112 or connector lead 111*a*, the facing anchor 412 is permitted to freely move in the vertical direction denoted by arrow B in FIG. 3D between adjacent cross wires 114.

In such an embodiment, the total length of the arms 426 as extended may be less than the distance B between the adjacent cross wires 114 through which the arms 426 are extended when vertically disposed. As noted above, the distance B may be a distance of about 4 inches on center from adjacent cross wires 114. However, as noted above, the distance B may vary based on the application, and accordingly, the total length of the arms 426 may vary to correspond with the distance B between applicable cross wires 114.

In another embodiment, the total length T of the arms 426 as extended may be greater than the distance B between the adjacent cross wires 114 through which the arms 426 are extended when vertically disposed. In such an embodiment, a portion (e.g., one of the arms 426) of the arms 426 may be inserted through the spacing between the vertical wires 112 or connector lead 111*a* from the side of the vertical facing 106 facing the horizontal element 104 (FIG. 2B) and manipulated in a vertical, forward, backward, or combination thereof direction, and subsequently rotated about ninety degrees, such that the anchor section 418 is oriented in a substantially horizontal position and at least the arms 426 are disposed on the side of the vertical facing 106 opposing the horizontal element 104.

Conversely, in an exemplary embodiment, the total length of the arms 426 as extended in the horizontal orientation may be greater than the distance between the corresponding vertical wires 112 or connector lead 111*a*, such that the arms 426 may prohibit the movement of the anchor section 418 from traveling back through the vertical facing 106. As noted above, this distance may vary depending on the particular application, but may generally include about a one inch separation.

As shown in FIG. 3D, lead ends 208 of the longitudinal wires 204 of the soil reinforcing element 202*a* may terminate substantially parallel to each other. The lead ends 208 may be connected by a pair of transverse wires 206 longitudinally offset from each other and disposed in a generally perpendicular fashion to the longitudinal wires 204. The transverse wires 206 may be joined to each longitudinal wire 204 by welds at their respective intersections. The pair of transverse wires 206 are further longitudinally offset such that the crimp 420 formed in the facing anchor 412 may be inserted through the grid opening 422 defined by the lead ends 208 and the longitudinally offset pair of transverse wires 206.

The connector 410 further includes a clasp 428 configured to secure the soil reinforcing element 202*a* to the facing anchor 412. In an embodiment, the clasp 428 may be manufactured from a continuous length of round-stock iron, plastic, or any similar material with sufficiently comparable tensile, shear, and compressive properties. The clasp 428 may form a generally C-shape including a generally straight clasp middle section 430 connecting a pair of arcuate clasp end sections 432*a,b*.

To secure the soil reinforcing element 202*a* to the vertical facing 106, the pair of transverse wires 206 longitudinally offset and disposed at the lead ends 208 of the soil reinforcing element 202*a* are aligned with the facing anchor 412 such that the crimp 420 is extended through the through the grid opening 422 defined by the lead ends 208 and the longitudinally offset pair of transverse wires 206. The clasp 428 is inserted between the crimp 420 and the lead ends 208 in the spacing defined by the crimp 420 and the lead ends 208 such that the vertical movement of the soil reinforcing element 202*a* relative to the facing anchor 412 is substantially restricted, thereby coupling the soil reinforcing element 202*a* to the facing anchor 412 and the vertical facing 106. The horizontal movement of the soil reinforcing element 202*a* is restricted by the contact of the crimp 420 with the longitudinally offset pair of transverse wires 206 and the lead ends 208.

Referring to FIG. 4, depicted is a plan view of the system 100 where at least four soil reinforcing elements 202 have been coupled to a wire facing 102. As illustrated, the soil reinforcing elements 202 may be attached to the wire facing 102 at one or more connector leads 111*a-g* of the horizontal element 104. In one or more embodiments, soil reinforcing elements 202 may be connected to each connector lead 111*a-g*, every other connector lead 111*a-g*, every third connector lead 111*a-g*, etc. For instance, FIG. 4 depicts soil reinforcing elements 202 connected to every other connector lead 111*a*, 111*c*, 111*e*, and 111*g*.

In one or more embodiments, the terminal wire 110*b* and/or median wire 110*c* may be located at a predetermined distance from the initial wire 110*a* to allow at least one transverse wire 206 of the soil reinforcing element 202 to be positioned adjacent the terminal and/or median wires 110*b*, 110*c* when the soil reinforcing element 202 is tightened against wire facing 102 with the connector 210. Accordingly, corresponding transverse wires 206 may be coupled or otherwise attached to the terminal and/or median wires 110*b*, 110*c*. In at least one embodiment, the transverse wires 206 may be positioned directly behind the terminal and/or median wires 110*b*, 110*c* and secured thereto using a coupling device (not shown), such as a hog ring, wire tie, or the like. In other embodiments, however, the transverse wires 206 may be positioned in front of the terminal and/or median wires 110*b*, 110*c* and similarly secured thereto with a coupling device, without departing from the scope of the disclosure. In yet other embodiments, the soil reinforcing element 202 is secured to only one or none of the terminal and/or median wires 110*b*, 110*c*.

In embodiments where the soil reinforcing element 202 is not coupled to the terminal or median wires 110*b*, 110*c*, it may be free to swivel or otherwise rotate in a horizontal plane as generally indicated by arrows A. As can be appreciated, this configuration allows the soil reinforcing elements 202 to swivel in order to avoid vertically-disposed obstructions, such as drainage pipes, catch basins, bridge piles, or bridge piers, which may be encountered in the backfill 103 (FIG. 1) field.

As shown in both FIGS. 1 and 4, the system 100 may further include a screen 402 disposed on the wire facing 102 once the soil reinforcing elements 202, 202*a* (FIG. 1) have been connected as generally described above. In one embodiment, the screen 402 can be disposed on portions of both the vertical facing 106 and the horizontal element 104. As illustrated, the screen 402 may be placed on substantially all of the vertical facing 106 and only a portion of the horizontal element 104. In other embodiments, however, the screen 402 may be placed in different configurations, such as covering the entire horizontal element 104 or only a portion of the vertical facing 106. In operation, the screen 402 may be configured to prevent backfill 103 (FIG. 1) from leaking, eroding, or otherwise raveling out of the wire facing 102. In one embodiment, the screen 402 may be a layer of filter fabric. In other embodiments, however, the screen 402 may include construction filter fabric, hardware cloth or a fine wire mesh made of plastic or metal. In yet other embodiments, the screen 402 may include a layer of cobble, such as large rocks that will not advance through the square voids defined in the vertical facing 106, but which are small enough to prevent backfill 103 materials from penetrating the wire facing 102.

Referring again to FIG. 1, the system 100 can be characterized as a lift 105 configured to build an MSE structure wall to a particular required height. As illustrated in FIG. 1, a plurality of lifts 105*a*, 105*b* may be required to reach the required height. Each lift 105*a*, 105*b* may include the elements of the system 100 as generally described above in FIGS. 2A, 2B, 3A-3D, and 4. While only two lifts 105*a*, 105*b* are shown in FIG. 1, it will be appreciated that any number of lifts may be used to fit a particular application and reach a desired height for the MSE structure. As depicted, the first lift 105*a* may be disposed generally below the second lift 105*b* and the horizontal elements 104 of each lift 105*a*, 105*b* may be oriented substantially parallel to and vertically-offset from each other. The angle of orientation for the vertical facings 106 of each lift 105*a*, 105*b* may be similar or may vary, depending on the application. For example, the vertical facings 106 of each lift 105*a*, 105*b* may be disposed at angles less than or greater than 90° with respect to horizontal.

In at least one embodiment, the vertical facings 106 of each lift 105*a*, 105*b* may be substantially parallel and continuous, thereby constituting an unbroken vertical ascent for the facing of the MSE structure. In other embodiments, however, the vertical facings 106 of each lift 105*a*, 105*b* may be laterally offset from each other. For example, the disclosure contemplates embodiments where the vertical facing 106 of the second lift 105*b* may be disposed behind or in front of the vertical facing 106 of the first lift 105*a*, and so on until the desired height of the MSE wall is realized.

In one or more embodiments, because of the added strength derived from the struts 118, each lift 105*a*, 105*b* may be free from contact with any adjacent lift 105*a*, 105*b*. Thus, in at least one embodiment, the first lift 105*a* may have backfill placed thereon up to or near the vertical height of the vertical facing 106 and compacted so that the second lift 105*b* may be placed completely on the compacted backfill of the first lift 105*a* therebelow. Whereas conventional systems would require the vertical facing 106 of the first lift 105*a* to be tied into the vertical facing 106 of the second lift 105*b* to prevent its outward displacement, the present disclosure allows each lift 105*a*, 105*b* to be physically free from engagement with each other. This may prove advantageous during settling of the MSE structure. For instance, where adjacent lifts 105*a*, 105*b* are not in contact with each other, the system 100 may settle without causing adjacent lifts to bind on each other, which can potentially diminish the structural integrity of the MSE structure.

Referring now to FIGS. 5A-5D, other embodiments of the disclosure include coupling or otherwise engaging the first and second lifts 105*a,b* in sliding engagement with one another using the connector 210,310,310*a*,410 of the soil reinforcing elements 202,202*a*. As shown in FIGS. 5A-5D, each lift 105*a*, 105*b* may have a corresponding vertical facing 106*a*, 106*b*. The first lift 105*a* may be disposed substantially below the second lift 105*b*, with its vertical facing 106*a* being placed laterally in front of the vertical facing 106*b* of the second lift 105*b*. Backfill 103 may be added to at least a portion of the first lift 105*a* to a first height or distance Y above the last facing cross wire 114. The second lift 105*b* may be disposed on top of the backfill 103, thereby being placed a distance Y above the last facing cross wire 114. As will be appreciated, the first height or distance Y can be any distance or height less than the distance X. For example, the distance Y can be about but less than the distance X, thereby having the backfill 103 level up to but just below the top-most cross wire 116 of the vertical facing 106*a*.

Figure 5A:
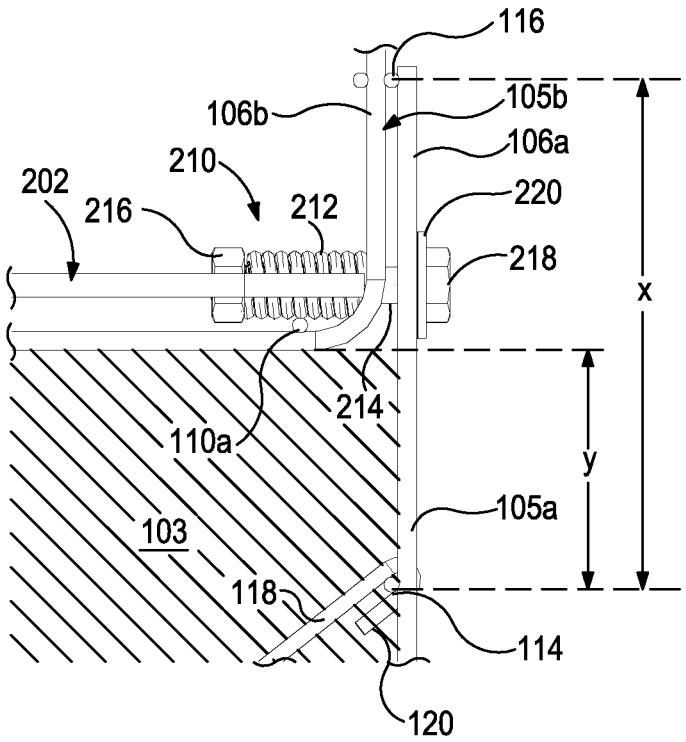
FIG. 5A is a side view of a connection apparatus for connecting at least two lifts or systems, according to one or more aspects of the present disclosure.

As shown in FIG. 5A, in order to bring the vertical facings 106*a,b* of each lift 105*a,b* into engagement or at least adjacent one another, the threaded rod 214 of the connector 210 may be configured to extend through each vertical facing 106*a,b* and be secured with the nut 216. In order to ensure a sliding engagement between the first and second lifts 105*a,b*, the nut 216 may be "finger-tightened," or tightened so as to nonetheless allow vertical movement of either the first or second lift 105*a,b* with respect to each other. Tightening the nut 216 may bring the coil 212 into engagement with the vertical facing 106*b* of the second lift 105*b*, having the coil rest on the initial wire 110*a*, and also bring the washer 220 into engagement with the vertical facing 106*a* of the first lift 105*a*. In at least one embodiment, tightening the nut 216 may also being the top-most cross wire 116 into engagement with the vertical facing 106*b* and thereby further preventing the outward displacement of the vertical facing 106*a*. However, in other embodiments, the top-most cross wire 116 is not necessarily brought into contact with the vertical facing 106*b*, but the vertical facing 106*b* may be held in its angular configuration by the strut 118 and connection device 120 disposed on the upper facing cross wire 114. In embodiments employing connectors 310,310*a*,410, the wire facing 102, particularly the horizontal element 104, may include a series of protrusions (not shown) formed in the horizontal element 104 by bending the horizontal wires 108 and/or connector leads 111*a-g* in an upward direction relative to the horizontal element 104.

Figure 5B:
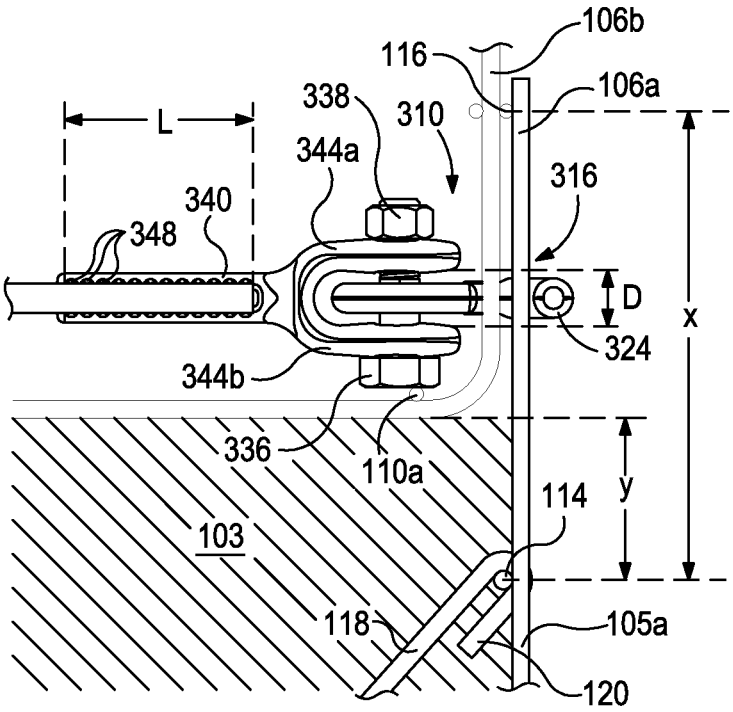
FIG. 5B is a side view of another connection apparatus for connecting at least two lifts or systems, according to one or more aspects of the present disclosure.
Figure 5C:
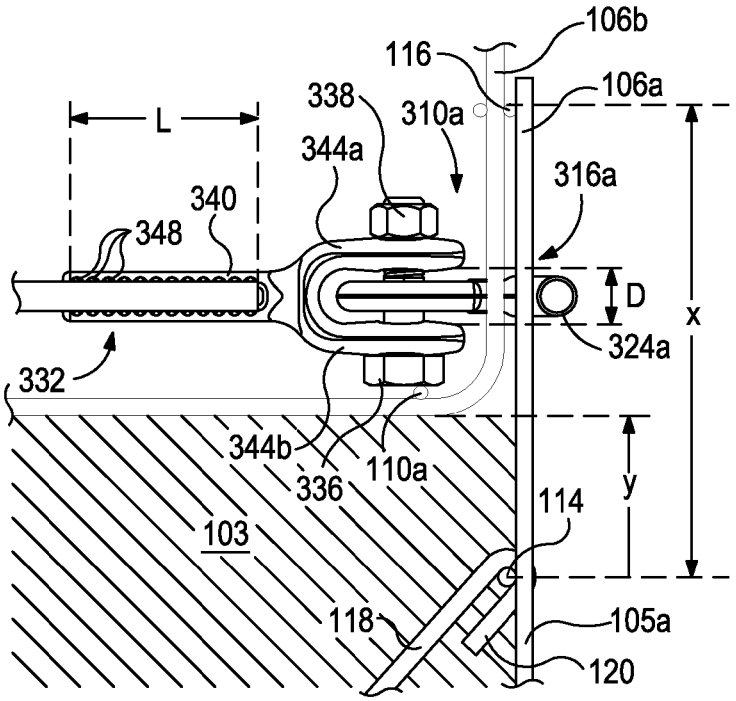
FIG. 5C is a side view of another connection apparatus for connecting at least two lifts or systems, according to one or more aspects of the present disclosure.
Figure 5D:
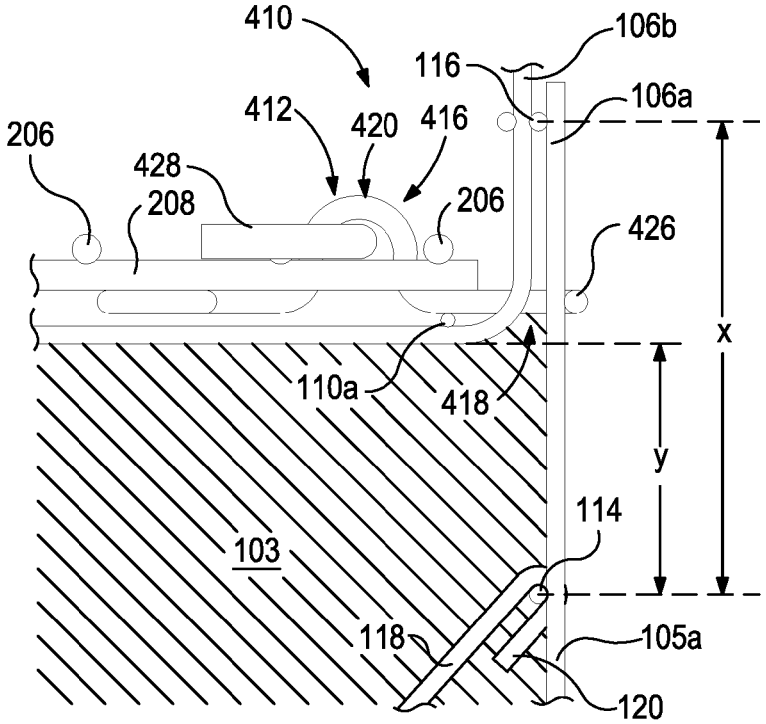
FIG. 5D is a side view of another connection apparatus for connecting at least two lifts or systems, according to one or more aspects of the present disclosure.

In another embodiment illustrated in FIG. 5B, in order to bring the vertical facings 106*a,b* of each lift 105*a,b* into engagement or at least adjacent one another, the facing anchor 312 of the connector 310 may be configured such that the arms 324 may be vertically disposed and inserted through each vertical facing 106*a,b* and subsequently rotated about 90° such that the arms 324 are horizontally disposed, thereby securing the securing the facing anchor 312 to the vertical facings 106*a,b*. In another embodiment illustrated in FIG. 5C, in order to bring the vertical facings 106*a,b* of each lift 105*a,b* into engagement or at least adjacent one another, the facing anchor 312*a* of the connector 310*a* may be configured such that at least a portion of the generally T-shape member 316*a* may be inserted through each vertical facing 106*a,b* and the anchor pin or arm 324*a* may be inserted therethrough the bore 330 formed in the arm housing 328 of the generally T-shape member 316*a*, thereby securing the securing the facing anchor 312*a* to the vertical facings 106*a,b*. In the embodiment of FIG. 5D, the facing anchor 412 may be configured such that at least a portion of the anchor section 418 may be vertically disposed, a force applied to the converging section 424, and inserted through each vertical facing 106*a,b* and subsequently rotated about ninety degrees. The force may then be removed from the converging section 424 such that the converging section 424 expands outward, thereby securing the facing anchor 412 to the vertical facings 106*a,b*.

Placing the second lift 105*b* a distance Y above the upper facing cross wire 114 allows the second lift 105*b* to vertically shift the distance Y in reaction to MSE settling or thermal expansion/contraction of the MSE structure. Accordingly, the distance Y can be characterized as a distance of settlement over which the second lift 105*b* may be able to traverse without binding on the first lift 105*a* and thereby weakening the structural integrity of the MSE system.

Figure 6A:
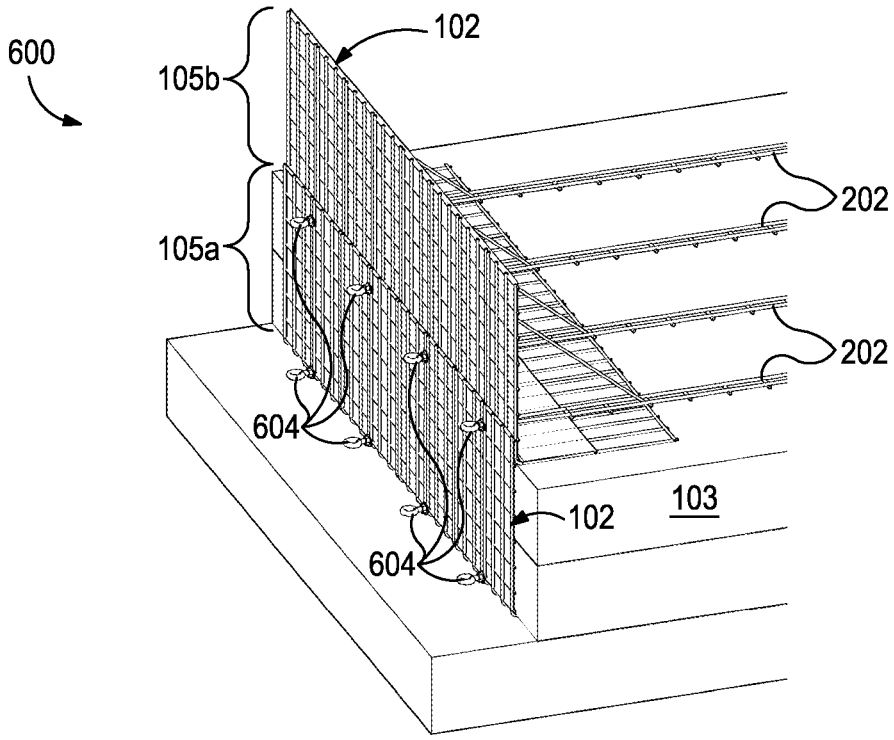
FIG. 6A is an isometric view of another system of constructing a mechanically stabilized earth structure, according to one or more aspects of the present disclosure.
Figure 6B:
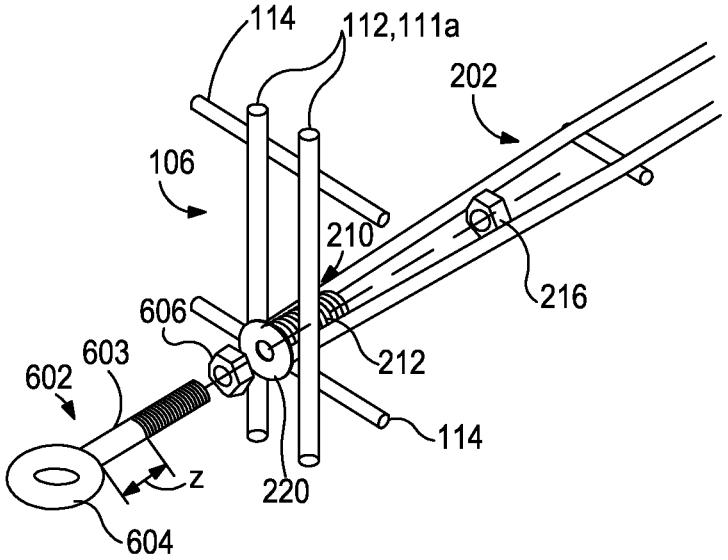
FIG. 6B is a side view of a soil reinforcing element used in the system shown in FIG. 6A, according to one or more aspects of the present disclosure.

Referring now to FIGS. 6A-6B, depicted is another exemplary embodiment of the system 100 depicted in FIG. 1, embodied and described here as system 600. As such, FIGS. 6A-6B may best be understood with reference to FIGS. 1-5D, wherein like numerals correspond to like elements and therefore will not be described again in detail. Similar to the system 100 generally described above, system 600 may include one or more lifts 105*a,b* stacked one atop the other and having one or more soil reinforcing elements 202 coupled the wire facings 102. The soil reinforcing elements 202 may extend into the backfill 103, and the backfill 103 may sequentially be added to the system 600 in a plurality of layers configured to cover the soil reinforcing elements 202 and provide tensile strength to each wire facing 102.

The soil reinforcing elements 202 in system 600, however, may include a different type of connector 210,310,310*a*, than described in system 100. For example, any type of threaded rod can be extended through the coil 212 and secured thereto with a nut 216, thereby replacing the threaded rod 214 as generally described with reference to FIG. 3. Referring to the exploded view of the connector 210 in FIG. 6B, a threaded eye-bolt 602 with a head 604 may be employed. As illustrated, the head 604 may be a loop. To secure the soil reinforcing element 202 to a portion of a wire facing 102, or in particular the vertical facing 106, the head 604 of the eye-bolt 602 may be disposed on the front side of at least two vertical wires 112, such as at a connector lead 111*a*, such that the body of the eye-bolt 602 can be extended through the coil 212 and secured thereto with the nut 216. As illustrated, the loop or head 604 may be prevented from passing through the vertical wires 112 or connector lead 111*a* by employing a washer 220 adapted to provide a biasing engagement with the vertical wires 112 or connector lead 111*a*. As the nut 216 is tightened, it brings the coil 212 into engagement or at least adjacent to the back side of the vertical facing 106, and the washer 220 into engagement with the vertical wires 112 or connector lead 111*a*.

In one or more embodiments, the body of the eye-bolt 602 may also be threaded through a second nut 606 adapted to be disposed against the washer 220 on the outside of the vertical facing 106. As illustrated, the body of the eye-bolt 602 can have a non-threaded portion 603 configured to offset the second nut 606 from the head 604 a distance Z when the second nut 606 is fully threaded onto the body. This may allow the head 604 to be laterally-offset from the vertical facing 106, as shown in FIG. 6A.

As can be appreciated, having the head 604 offset from the vertical facing 106 may provide a location to attach or otherwise form a facing (not shown) to the system 600. For example, rebar may be passed through or otherwise coupled to the heads 604 of each connector 210, thereby providing a skeletal rebar structure prepared to be formed within a facing structure, such as being cast within a concrete skin. Moreover, lengths of rebar may be used to attach turnbuckles or other connection devices configured to couple the vertical facing 106 to a laterally-adjacent facing. As illustrated, the loop or head 604 may be horizontally-disposed, but may also be vertically-disposed without departing from the scope of the disclosure. Consequently, rebar may be passed either vertically or horizontally through adjacent loops or heads 604 in various embodiments of the system 600. Exemplary connective systems that may be used in conjunction with the present disclosure can be found in co-pending U.S. patent application Ser. No. 12/132,750, entitled "Two Stage Mechanically Stabilized Earth Wall System," filed on Jun. 4, 2008 and hereby incorporated by reference to the extent not inconsistent with the present disclosure.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A mechanically stabilized earth structure, comprising:

a wire facing having a bend formed therein to form a horizontal element and a vertical facing, the horizontal element having initial and terminal wires each coupled to a plurality of horizontal wires, and the vertical facing comprising:

a plurality of vertical wires coupled to a plurality of facing cross wires and a top-most cross wire; and a plurality of connector leads extending from the horizontal element and up the vertical facing, each connector lead comprising two vertical wires of the plurality of vertical wires, the two vertical wires being laterally offset from each other by a short distance;

a soil reinforcing element having a plurality of transverse wires coupled to at least two longitudinal wires having lead ends that converge; and a connector configured to detachably couple the soil reinforcing element to the wire facing such that at least a portion of the soil reinforcing element extends beyond an end portion of the horizontal element, comprising:

a facing anchor comprising a plate defining a plate aperture and being integral with or coupled to an extension member configured such that at least a portion of the extension member is inserted between the two vertical wires of a connector lead of the plurality of connector leads whereby the facing anchor is detachably coupled to the vertical facing;

a connective stud comprising a straight shaft with a first end configured to be coupled to the soil reinforcing element and a second end terminating with a first prong and a second prong, each extending axially from the shaft and offset from the other, such that a gap is defined therebetween; and a coupling device configured to couple the facing anchor to the connective stud.

2. The structure of claim 1, wherein the first prong defines a first prong opening and the second prong defines a second prong opening, such that the first prong opening and second prong opening are co-aligned.

3. The structure of claim 2, wherein the coupling device comprises a nut and bolt assembly comprising:

a bolt configured to be inserted therethrough the first prong opening, the plate aperture, and the second prong opening when the first prong opening, the plate aperture, and the second prong opening are co-aligned; and a nut configured to be coupled to the bolt, thereby coupling the facing anchor to the connective stud, such that the soil reinforcing element may be translated within a horizontal plane.

4. The structure of claim 1, wherein the shaft defines a plurality of grooves along an axial length of the shaft, the grooves, and the lead ends of the soil reinforcing element are welded to the shaft, such that the grooves provide a more solid resistance weld surface for welding the lead ends to the shaft.

5. The structure of claim 1, wherein the extension member forms a generally T-shape member comprising a center member and one or more arms integral with or coupled to the generally T-shape member and extending from the center member, the one or more arms being configured to be inserted between the two vertical wires of the connector lead and through the vertical facing and to detachably couple the facing anchor to the vertical facing, such that the facing anchor may be translated in a vertical direction relative to the vertical facing.

6. The structure of claim 1, wherein the extension member forms a generally T-shape member comprising a center member and an arm housing disposed substantially perpendicular to and integral with the center member, the arm housing defining a bore therethrough configured to receive an arm therethrough such that the facing anchor is detachably coupled to the vertical facing when the arm housing is inserted between the two vertical wires of the connector lead and through the vertical facing and the arm is disposed within the bore, the facing anchor capable of being translated in a vertical direction relative to the vertical facing.

7. A method for constructing a mechanically stabilized earth structure, comprising:

providing a first lift comprising a first wire facing being bent to form a first horizontal element and a first vertical facing, the first horizontal element having initial and terminal wires coupled to a plurality of horizontal wires, and the first vertical facing comprising:

a plurality of first vertical wires coupled to a plurality of facing cross wires including a last facing cross wire and a top-most cross wire; and a plurality of first connector leads extending from the first horizontal element and up the first vertical facing, each first connector lead comprising two vertical wires of the plurality of first vertical wires, the two vertical wires of the plurality of first vertical wires being laterally offset from each other by a short distance;

inserting an extension member of a facing anchor comprising a plate and the extension member between the two vertical wires of a first connector lead of the plurality of first connector leads and through the first vertical facing;

disposing one or more arms coupled to or integral with the extension member in a substantially horizontal disposition, such that the one or more arms prohibit the extension member from passing back through the first vertical facing, thereby detachably coupling the facing anchor to the first vertical facing;

coupling a plurality of converging lead ends of longitudinal wires of a first soil reinforcing element to a straight shaft of a connection stud comprising a first end of the shaft and a second end of the shaft terminating with a first prong and a second prong, each prong extending axially from the shaft and further being offset from each other, such that a gap is defined therebetween;

disposing the plate defining a plate aperture within the gap, such that a first prong opening defined by the first prong and a second prong opening defined by the second prong are each co-aligned with the plate aperture;

inserting a bolt therethrough the co-aligned first prong opening, second prong opening, and plate aperture and coupling a nut to the bolt, such that the facing anchor is coupled to the connection stud and at least a portion of the first soil reinforcing element extends beyond an end portion of the first horizontal element;

placing a screen on the first wire facing whereby the screen covers at least a portion of the first vertical facing and first horizontal element; and placing backfill on the first lift to a first height above the last facing cross wire of the first vertical facing, wherein the first height is below the top-most cross wire.

8. The method of claim 7, further comprising coupling a first end of a strut to the first vertical facing and a second end of the strut to the first horizontal element, the strut being configured to maintain the first vertical facing at a predetermined angle with respect to the first horizontal element.

9. The method of claim 8, wherein the first end of the strut is coupled to the last facing cross wire and the second end of the strut is coupled to the terminal wire.

10. The method of claim 9, further comprising placing a second lift on the backfill of the first lift, the second lift comprising a second wire facing being bent to form a second horizontal element and a second vertical facing.

11. The method of claim 10, wherein the second lift is not in contact with the first lift but is completely supported by the backfill of the first lift.

12. A mechanically stabilized earth structure, comprising:

a wire facing having a bend formed therein to form a horizontal element and a vertical facing, the horizontal element having initial and terminal wires each coupled to a plurality of horizontal wires, and the vertical facing comprising:

a plurality of vertical wires coupled to a plurality of facing cross wires and a top-most cross wire; and a plurality of connector leads extending from the horizontal element and up the vertical facing, each connector lead comprising two vertical wires of the plurality of vertical wires, the two vertical wires being laterally offset from each other by a short distance;

a soil reinforcing element having a plurality of transverse wires coupled to at least two longitudinal wires having lead ends that terminate substantially parallel to one another; and a connector configured to detachably couple the soil reinforcing element to the wire facing such that at least a portion of the soil reinforcing element extends beyond an end portion of the horizontal element, comprising:

a facing anchor comprising a continuous wire bent about 180 degrees back about itself about a center section of the continuous wire, the facing anchor comprising:

a coupling section forming a protrusion configured to extend through a grid opening defined by the plurality of transverse wires coupled to the at least two longitudinal wires; and an anchor section comprising a convergent section formed from the continuous wire converging from the protrusion and a pair of arms extending tangentially from the convergent section, the pair of arms configured to be inserted between the two vertical wires of a connector lead of the plurality of connector leads and through the vertical facing such that the facing anchor is detachably coupled to the vertical facing; and a coupling device configured to be inserted between a spacing defined between the protrusion and the soil reinforcing element, thereby detachably coupling the soil reinforcing element to the facing anchor and the vertical facing.

13. The structure of claim 12, wherein the coupling device comprises a clasp forming a generally C-shape, the clasp comprising a generally straight clasp middle section connecting a pair of arcuate clasp end sections.

14. The structure of claim 12, wherein the convergent section is further configured such that the convergent section comprises:

a first width less than a distance between the two vertical wires of the connector lead when an external force is applied to the convergent section; and a second width greater than the distance between the two vertical wires of the connector lead when the external force is removed from the convergent section.

15. A method for constructing a mechanically stabilized earth structure, comprising:

providing a first lift comprising a first wire facing being bent to form a first horizontal element and a first vertical facing, the first horizontal element having initial and terminal wires coupled to a plurality of horizontal wires, and the first vertical facing comprising:

a plurality of first vertical wires coupled to a plurality of facing cross wires including a last facing cross wire and a top-most cross wire; and a plurality of first connector leads extending from the first horizontal element and up the first vertical facing, each first connector lead comprising two vertical wires of the plurality of first vertical wires, the two vertical wires of the plurality of first vertical wires being laterally offset from each other by a short distance;

applying a force to a convergent section of a facing anchor formed from a continuous wire bent about 180 degrees back about itself about a center section of the continuous wire, the force causing a width of the convergent section to be less than a distance between the two vertical wires of a first connector lead of the plurality of first connector leads;

inserting the facing anchor between the two vertical wires of the first connector lead such that a pair of arms extending tangentially from the convergent section are substantially vertically disposed;

rotating the facing anchor about ninety degrees, such that the pair of arms are substantially horizontally disposed and are further disposed on an opposing side of the first vertical facing from a protrusion formed in a coupling section of the facing anchor, such that the arms are prohibited from returning between the two vertical wires of the first connector lead, thereby detachably coupling the facing anchor to the first vertical facing;

removing the force applied to the convergent section, such that the width of the convergent section is at least substantially equal to the distance between the two vertical wires of the first connector lead;

extending the protrusion through a grid opening formed from a pair of substantially parallel lead ends of longitudinal wires coupled to at least two adjacent transverse wires of a first soil reinforcing element;

extending a coupling device through a space formed beneath the protrusion and above the pair of substantially parallel lead ends of longitudinal wires such that the first soil reinforcing element is detachably coupled to the facing anchor and at least a portion of the first soil reinforcing element extends beyond an end portion of the first horizontal element;

placing a screen on the first wire facing whereby the screen covers at least a portion of the first vertical facing and first horizontal element; and placing backfill on the first lift to a first height above the last facing cross wire of the first vertical facing, wherein the first height is below the top-most cross wire.

16. The method of claim 15, wherein the coupling device comprises a clasp comprising a generally straight clasp middle section connected to a pair of arcuate clasp end sections.

17. The method of claim 16, wherein the at least two adjacent transverse wires of the first soil reinforcing element are generally perpendicular to one another.

18. The method of claim 15, further comprising coupling a first end of a strut to the first vertical facing and a second end of the strut to the first horizontal element, the strut being configured to maintain the first vertical facing at a predetermined angle with respect to the first horizontal element.

19. The method of claim 15, further comprising placing a second lift on the backfill of the first lift, the second lift comprising a second wire facing being bent to form a second horizontal element and a second vertical facing.

20. The method of claim 19, wherein the second lift is not in contact with the first lift but is completely supported by the backfill of the first lift.

* * * * *